US007963864B2

(12) United States Patent
Frost

(10) Patent No.: US 7,963,864 B2
(45) Date of Patent: Jun. 21, 2011

(54) HAND ACCESSORY

(76) Inventor: John H. Frost, Woodland Hills, CA (US)

( * ) Notice: Subject to any disclaimer, the term of this patent is extended or adjusted under 35 U.S.C. 154(b) by 171 days.

(21) Appl. No.: 12/316,437

(22) Filed: Dec. 12, 2008

(65) Prior Publication Data

US 2010/0151974 A1 Jun. 17, 2010

(51) Int. Cl.
*A63B 69/00* (2006.01)

(52) U.S. Cl. ..... 473/458; 473/206; 2/20

(58) Field of Classification Search ..... 473/458, 473/207, 212, 213, 206, 201–205; 2/20
See application file for complete search history.

(56) References Cited

U.S. PATENT DOCUMENTS

| | | | |
|---|---|---|---|
| 2,710,190 | A | 6/1955 | Schimansky |
| 3,606,614 | A | 9/1971 | Dimitroff |
| 4,461,043 | A | 7/1984 | Lomedico |
| 4,836,544 | A | 6/1989 | Lai |
| 5,069,454 | A | 12/1991 | Frost |
| 5,180,165 | A | 1/1993 | Frost |
| 5,322,286 | A | 6/1994 | Frost |
| 5,588,651 | A | 12/1996 | Frost |
| 5,704,845 | A | 1/1998 | Boyte |
| 7,179,180 | B1 | 2/2007 | Frost |
| 7,431,671 | B1 | 10/2008 | Frost |

*Primary Examiner* — Gene Kim
*Assistant Examiner* — M Chambers
(74) *Attorney, Agent, or Firm* — Sandy Lipkin

(57) ABSTRACT

A hand accessory designed to harness power from strong areas of the hand and channel stress away from weaker areas by means of anchors pressing into tough fleshy areas with connecting structure capable of leveraging a handle away from sensitive bony areas, relocating fleshy areas into supporting and insulating positions, preventing bone bruises and widening the effective grip of the hand for greater control while augmenting the hand's range of motion especially in swinging a baseball bat.

40 Claims, 9 Drawing Sheets

HAND ACCESSORY

BACKGROUND OF THE INVENTION

1. Field of the Invention

The field of this invention relates generally to hand accessories useful for improving the control and gripping strength of the hand in connection with the handle of an implement, such as a baseball bat, thereby reducing stress to the hand and providing greater control of the handle. More specifically, the current invention distributes force from a recoiling or heavy handle in varying degrees to various areas of the hand in accordance with the suitability of those areas in absorbing force, and/or transferring force to a handle, thus stronger areas of the hand are utilized than would be possible without the invention.

2. Description of the Prior Art

The subject matter of the present invention is an improvement over the structure defined within U.S. Pat. No. 7,179,180 B1 filed Apr. 26, 2005 and U.S. Pat. No. 7,431,671 filed Mar. 10, 2006, invented by the present inventor and designed to enhance the user's gripping and/or swinging strength primarily in conjunction with a baseball bat, but also with any other round, thin handle, such as a weight lifting bar, tool, bicycle or steering wheel. (All other prior art by the current inventor was reviewed extensively during the prosecution of U.S. Pat. No. 7,431,671.)

The present invention shall be contrasted to fifth embodiment 203 (FIGS. 13-19) (examiner's Group V) and sixth embodiment 300 (FIGS. 20-26), both of U.S. Pat. No. 7,179,180 B1, and seventh embodiment 400 (FIGS. 27-35) of U.S. Pat. No. 7,431,671. Embodiment 203, claimed independently, is the basis for all following embodiments by the current inventor because 203 absorbs the majority of the force (or stress) of a recoiling or heavy handle and disperses that stress into the lower, stronger portion of the hand (the "lower hand"), thereby minimizing the job of any structure located in the upper portion of the hand "upper hand". Thus, the whole structure of embodiment 203 is the basis of tough ball anchors 310 and 410 (located in the lower hand) in embodiments 300 and 400 and now current embodiment 500 (lower hand grip 510). The purpose of upper hand structure has been primarily to protect the thumb bone from bruising without adding stress to the upper hand. The upper hand structure of embodiment 300 (lifeline anchor 320) was comfortable but did not provide enough thumb protection. The inventor's prior two patents explained the problem of bulkiness in the upper hand/web area: although many forms of padding may serve to protect the thumb from bruising, the bulkiness created by the padding also receives and creates more stress in the weaker upper hand as well as discomfort in the gripping process. The problem of thumb protection without bulkiness was not satisfactorily improved until the discovery of upper hand anchor 420 of embodiment 400 (now upper hand grip 520), which has several unique structures, especially the key structure of web anchor 418 (now outer web anchor 518) which made the whole upper hand anchor 420 workable. The structure of the current invention appears similar to a combination of embodiment 203 and upper hand anchor 420 of embodiment 400. Most of the anchors remain fixed in their same or similar locations of the hand, however the various receiving and dispersing structures have been modified to better account for and conform to the hand's full range of motion (described under "Grip Analysis"). This allows the hand accessory to actually move into and out of supporting positions at the various phases of the grip, while also performing more efficiently with less structure and thinner material, thereby capturing and relocating fleshy areas into more supporting positions, removing stress from weaker, sensitive areas of the hand. The current structures will be named the same and numbered with the same last two digits as the similar structure defined in embodiment 400 in most cases.

Embodiment 400, used in games by some professional baseball players, was difficult to improve upon. It provided adequate thumb joint protection and had perfect comfort and bat control in the initial gripping position (phase one) and good control in the ending position (phase three/four), but did not conform perfectly to the hand's "tuck" movement in phase two, and was not widely accepted for bottom hand usage.

Note: For simplicity, the tendons in the metacarpal area (felt in the palm of the hand) are referred to as middle finger tendon, ring finger tendon etc.

An ongoing problem has been bulkiness in the web area not only adding stress to the upper hand at the wrist, but also impinging on the middle and index finger tendons as the thumb base moves downward, as well as stress on the thumb's second joint, third joint (carpal area) and thumb base muscles. The current invention describes a sensitive mid-palm 28 as being the area of index finger tendon 6 and middle finger tendon 7, and a less-sensitive palm 18, being a somewhat tough area extending inward from ring finger hollow 8 ending just outward of bony heel 43. The upper portion of embodiment 203 extended to and ended anchoring at less sensitive palm 18 (described as ring finger trough area 18 at that time) avoiding middle finger tendon 7. Embodiment 300 also avoided sensitive mid-palm 28 by connecting upper hand anchor to lower hand anchor at the lower lifeline by the wrist with swivel 330. However, neither 203 nor 300 provided adequate protection of the thumb from bruising. Embodiment 400 avoided sensitive mid-palm 28 by lifeline/web anchor 425 anchoring (pressing in) just above index finger tendon 6 at lower web 32 and arcing into lifeline 36 transferring force downwardly along thumb base/lifeline anchor 452 and thence to lower anchoring areas at the thumb base, wrist and tough ball areas, thus circumventing sensitive mid-palm 28, but allowing slightly more stress to be received in the thumb and upper portions than was desired by the current inventor and also not allowing a completely unrestrained phase two movement (see "Grip Analysis").

Another problem with previous embodiments was stabilizing the primary contact area 506 against the inertial force of a bat being swung (hand parallel to the ground, bottom of the hand leading), forcing the hand accessory upwards in the hand. This was accomplished by very thick structure in embodiment 203, thinning and becoming more flexible in embodiments 300 and 400, but not to total satisfaction. The thick, less flexible structure of 203, weighing 54 grams, definitely widened the effective grip of the hand, but the primary contact point made contact from phase one through phase four, which was helpful through phase two, but created some blocking of the handle rotation inward toward the wrist at and following phase four (the follow through). Embodiments 300 and 400 had less direct contact at the primary contact area and were more comfortable, but still absorbed too much handle force in the upper portion of the little finger, the ring finger and tough ball areas, rather than the desired lower tough ball, the strongest, toughest area of the hand.

Current lower hand grip 510, appearing from a distance the same as embodiment 203 but weighing only 16 grams, is structured in such a way as to support handle 48 further outward in the fingers with less thickness than all previous embodiments, with primary contact area 506 moving up (externally) to contact the handle only at phase two, then returning to its position below (internal) of the handle during phase three and four and the follow through of the swing, this being especially important in bottom hand gripping, with the flared handle creating interference with an extended primary contact point otherwise.

The above feature was accomplished by a number of structural changes which also accomplished the goal of providing a complete phase two grip and the hand accessory being useable for bottom hand gripping of a baseball bat. Part of the discovery occurred by cutting the hand accessory lengthwise (see 500A FIG. 3) from the area of thumb joint anchor 522 dissecting down to what is now handle wedge 505 and ridge 504 ending just above the lower edge of fulcrum platform 502, and then moving the inner portion downward and somewhat forward such that when reconnected, handle wedge 505 became apparent (see 500B, FIG. 6) and the whole arcing edge 507 was much lower than embodiment 400, extending further below little finger knuckle 27 and lower tough ball 39. This improvement was to allow the inner hand to move fully lower and outward during phase two grip, but also resulted in providing greater support for handle 48, as the area from handle wedge 505 upwards to the lower portion of bridge 540 now rises externally behind (inward of) handle 48 in support of handle 48, as a portion of the primary contact area 506 which extends below the hand is allowed to depress internally with no direct contact with the hand (internally of handle wedge 505), dispersing most of the inertial force into the lower tough ball 39 rather than into upper areas.

The external movement of primary contact area 506 to contact the handle at phase two and then resume its lower position at phase three, called upward rotation, is the result of the above, plus a number of other structural changes such as a very high arcing bridge conforming to little knuckle phase two movement (described following), which when pressed internally and upwardly by the recoiling handle (inertial handle force) creates a rotation at primary contact area 506 pressing the upper area internally while the lower area rises up externally, aided by phase two outward movement of the hand's lower tough ball at fulcrum ridge 504 forcing fulcrum platform 502 outwardly, rotating primary contact area 506 externally following bridge 540 being pressed inwardly and upwardly, the external rotation of primary contact area 506 aided by a rotational bending at anchor flex 572 in the outward portion of relocation channel 570 and an inward (concave) bending at concave platform 539 during phase one moving to an outward (convex) bending at concave platform during phase two.

Definition of Directions: For directional purposes, the areas of hand accessory 500, defined as upper, lower, outward (or forward) and inward, shall be used to apply to coinciding areas of the hand (see FIG. 1), the hand's upper portion (upper hand) being the thumb, web and index knuckle area, the lower portion (lower hand) being the little finger/tough ball area. Outward direction (or forward) is toward the fingers. The outer hand is outward of shift line 9. Inner direction is toward the wrist. The inner hand is everything inward of shift line 9. Note: Since the natural tendency is to think of the palm as "inward" from the thumb, this reminder: extending from the wrist or thumb toward the palm is an "outward" direction. Moving up a line perpendicular to the palm would be "exterior" or away from the hand, moving down the line would be "interior" or deeper in the hand. The interior, back or rear side of hand accessory 500 is the side pressed against the hand.

Grip Analysis for Gripping and Swinging a Baseball Bat

Top hand (right for a right hand hitter): The following shall describe a "finger grip". In Phase one the grip starts to tighten with the handle held against the knuckles outward of the hand's shift line 9, the upper hand tilting rearward away from the handle as the bat begins to move from a vertical position to a horizontal position (see "top hand tilt" under "Demonstration" for further significance. The finger grip displaces the skin outward of shift line 9 inward (internally during gripping) relocating and compacting the skin into the area of ring finger hollow 8 as a slight bulge, partially supporting handle 48, this to be known as shift line support 10. Phase two, the power phase, is characterized by further tightening outside of shift line 9, with the inner hand (including the tough ball and thumb base) pivoting downward and outward (toward the handle), the lower tough ball "tucking" partially under the handle as the elbow of the batter draws in toward the ribs creating a slight clockwise motion of the hand and also a more "cocked" position (see "clockwise" under Demonstration). In phase three, the control phase, the upper hand un-cocks and moves forward, as the lower fingers move relatively toward the batter while the thumb reverses direction moving upward and outward (away from the batter) attempting to direct the handle for accuracy, now creating a slightly counterclockwise rotation, whereby the upper knuckles move away from the handle and the thumb moves toward the handle reducing space between the handle and hand and creating stress to the thumb and possible bruising to the thumb second joint. At the end of phase three, there is little space left for any hand accessory material, which creates a challenge in finding a means of insulating the thumb from bruising. Phase four, also called "full grip" is a combination of phase two and phase three occurring together as the hand tightens to its strongest gripping strength (explained more fully following).

The above described change in positions happens so fast it is not readily apparent even in a slow motion analysis of a hitter, especially if the pitch is high and outside and/or the hitter swings late and "goes to the opposite field"; the movement into phase two position, which resembles a golf grip, is more apparent on a low, inside pitch and/or when the hitter "pulls" the ball.

It is important to understand that there is another reason why the hand movement is not readily apparent: After the hand "un-cocks" and fully tightens going from phase two to phase four, the amount of distance the inner hand moves toward the outer hand (from a firm grip to a fully tightened grip) may vary between only ¼ to 1/16 inch along shift line 9. That distance must be allowed by the hand accessory in order to achieve maximum grip strength, modified only by thumb spread 526 and other upper hand anchoring structure bracing only the upper area of the thumb away from the handle in a more open position (explained in the detail).

Demonstration: Place one's left thumb on one's right hand in the area just outward of ring finger hollow 8 and apply a pincer grip (left hand fingers at the back). Squeeze the right hand tightly. Notice the hand's fleshy bulge 13 moves under one's thumb (forward past ring finger hollow 8) while the hand's upper web 46 also moves forward past ring finger hollow 8 in phase four grip. In fact, all the following hand movements may be readily observed by applying the above grip at ring finger hollow 8 which is a stationary pivotal area as the hand pivots downward into phase two, then upward into phase three, and finally fully tightens (described above) moving forward in a combination of phase two and three. The final forward movement of the inner hand (at phase four full grip) is mostly a compaction (as an accordion being squeezed).

"Clockwise motion" is observed from a top view of the gripping hand in phase one through phase two, and is actually the upper, outer hand moving internally, or rearward, (especially the top two fingers) while the inner hand is moving externally (closing), the clockwise motion allowing the fingers to maintain control of the handle, the upper fingers moving rearward with the inertial handle while the inner hand moves forward past the handle, the upper portion not being jammed by the handle in phase two. The clockwise motion is enhanced by thumb spread 526 pressing into lower web 32 and other structure within current upper hand grip 500 filling the hand's lower web, extending phase two grip and somewhat limiting phase three grip, but only in the upper, second joint portion of the thumb.

Note: For simplicity, the hand's thumb connection in the carpal area is referenced "thumb third joint". Illustration: the only structural attachment of the thumb to the hand is at the third joint by the wrist. The thumb's web attachment to the index finger is like a pole A (thumb) spaced apart at the top and attached to a pole B by a leather hinge, the bottoms of the two poles joined by a spring. Pushing pole A forward and downward will have no effect except to possibly jam the top area into pole B (the thumb second joint hits the handle); however, apply a brace against the leather hinge mid-way between pole A and pole B (thumb spread pressing into the lower web), then push on pole A and force will transfer to the bottom of pole A (thumb transfers force through the third joint to the lower hand itself, and a force will pull pole B rearward relatively past the brace (the upper, outer hand moves rearward maintaining control of the handle). This may also be demonstrated by pressing one's left thumb into the lower web, the left thumb anchored at less sensitive palm 18, not impinging on the outer hand, and watching the outer hand move rearward as the thumb closes (moves forward).

The little finger knuckle, being an exception to the above described rearward movement, moves not only externally in closing (gripping) but also attempts to move downwardly when swinging a bat in phase two. This little finger knuckle movement is to be described as little knuckle phase two position. All current embodiments are now better conforming to phase two clockwise motion than any previous inventions. Current embodiments 500B, C and D now conform to little knuckle phase two position.

Notice also another movement (with pincer grip applied): the upper hand may pivot rearward (toward the back of the hand) tilting away from the handle while the lower hand pivots (or tilts) toward the handle which is the motion at phase one, top hand, as the bat begins moving from vertical to horizontal going into phase two, to be known as "top hand tilt". Top hand tilt is partially responsible for upward rotation, bringing the lower portion of primary contact area 506 in contact with handle 48; the hand may do the opposite movement, the upper hand pivoting towards the handle while the lower hand pivots away, which is the movement occurring in the bottom hand grip (following). Bottom hand (left for right hand hitter): the bottom hand stays in a phase two grip, same as phase two top hand only slightly more open (the lower hand tilted away from the handle, see above) throughout the entire swing (flared handles already accommodating the lower hand tilt). The significance of this is that the solutions to the phase two deficiency of embodiment 400 have also improved current hand accessory 500 for bottom hand usage as well.

From the above analysis, one can see why hitting coaches disagree over whether the grip should be tight or relaxed, as they probably are thinking about different stages of the grip. In order for the hand to move fully into phase 2 it is necessary to keep the upper portion of the hand (index finger and thumb area) somewhat relaxed. It is only in phase 3 and 4 where the index finger fully tightens on most pitches.

See FIG. 1, depicting an open hand. Then see FIG. 2, depicting phase 2 grip: notice point A and point B have moved closer to each other, depicting a large loss of space in the lower hand that occurs when swinging a baseball bat (and this is before the final "accordion type" loss of space at full grip). Not apparent in FIG. 2 is that the area of point B not only moves closer but also lower than point A which is being pressed upwardly by the handle gripped by the lower fingers (although the little finger knuckle is attempting to move downwardly), the handle being parallel to the ground inertially forcing the knuckles (everything outside of the transverse crease) upward relative to the downward, outward moving inner portion of the hand. Space required to allow the whole inner hand to move to its full grip is roughly 1¼ inches at the lower area and ½ inch at the upper area.

In FIG. 2, though point B tough ball area 38 is the most pronounced and noticeable area of movement, the entire inner hand changes position all along shift line 9 relative to the outer hand holding the handle. When embodiment 400 moved (with the motion of the hand) into phase two position, the anchors all remained fixed in their places and the upper portion (upper anchor 420 moved downward and outward (forward) with no impingement of the sensitive mid-palm. However movement of thumb base 30 was somewhat restricted from moving fully forward and downward because of the connection of embodiment 400 just below mid-palm anchor 415 with tough ball anchor 410. Upper anchor 420, moving toward primary contact point 406, although supplying support to primary contact point 406, also created a bulge (seen without the glove), the bulge when held firm under the pressure of an external glove and handle resulting in a feeling of too much thickness in the area of tough ball 38, and a slight restriction in the gripping range of motion all along shift line 9. Cutting out the bulging area and rejoining embodiment 400 does not solve the problem as there would not then be enough material to allow the hand to finish the phase three motion (the anchors pull out of place), and also because the design of tough ball 410 did not allow the hand's lower tough ball 39 to move fully outward (see the basic solution on pages 5 & 6).

Current hand accessory 500 allows the full range of necessary hand motion, in fact augmenting that motion, while limiting a certain undesirable hand motion for optimal performance, anchoring now more successfully in the main areas described in embodiment 400 and in new areas with new structure, dispersing still more stress away from sensitive hand areas to be received in stronger, tougher areas of the hand.

SUMMARY OF THE INVENTION

Hand accessory 500 consists of anchors which transfer power from otherwise unused strong and/or tough, fleshy areas of the hand, transferring that power to receiving areas through dispersing structure which may act as a bridge, or a lever, or an anchor of the structures bridging or leveraging, or an anchor which is also a "fulcrum" directly under the lifting area (handle area) with a lever extension, or a combination of anchor including fleshy relocation, or a combination of all the structures above depending on the area, the hand's gripping position and type of handle being held.

The main effect of improvements in hand accessory 500 over previous embodiments by the current inventor is the distribution of force from the handle in a greater degree to the tougher, stronger areas which are in the lower hand, and a lesser degree (less stress) in the upper hand, allowing the lower hand to supply more power while the upper hand supplies greater control, lower hand grip 510 channeling greater force through the hand's lower tough ball 39 and upper hand grip 520 confining the remainder of force (stress) to tough, fleshy areas of the web, avoiding stress or impingement to the thumb muscle and the congested area of sensitive joints and tendons between the thumb and fingers.

Hand accessory 500 (FIGS. 3-14A) improves over embodiment 400 (U.S. Pat. No. 7,431,671) with upper hand grip 520 capturing greater leverage from the web and thumb base and providing protection to the thumb second joint without adding stress to the thumb or any buckling of hand accessory material. An important improvement was the discovery of a means of retaining the leveraging ability of web anchor 418 (now outer web anchor 518) (explained in previous patents) without attachment to lower structure in the area of the hand's lower web 32 and index finger tendon 6, (see FIGS. 7, 8, 9 & 11) providing an equal amount of protection from bruising to the thumb joint while allowing unrestricted thumb base expansion and downward movement with no stress to the thumb or impingement at the index finger tendon 6. Lower hand grip 510 (previously tough ball anchor 410), with upper apex 501, primary fulcrum point 513, recess junction 503, primary contact extension 543 and anchor flex 572 is a redesigned, more arcing structure, made of thinner material interfacing more efficiently with the hand such that it is less bulky and yet provides better support for handle 48, leveraging handle 48 further outward in the fingers than in embodiment 400 with no impingement or restriction at the hand's fleshy bulge 13 or impingement of the little finger knuckle 27 due to little knuckle phase two angle, or limitation of full phase two range. Upward rotation (see prior explanation) allows primary contact area 506, and a new lower portion, primary contact extension 543 to move into full contact with handle 48 at phase two and then resume an interior position by phase four and the follow-through. Upper hand grip 520 and lower hand grip 510 have been successfully joined in a lower area of the hand than that found in embodiment 400, thereby reducing stress to the upper hand, dispersing stress more evenly over a broader range in the lower hand, bridging over the sensitive mid-palm (with added support of fleshy thumb base relocation from a redesigned upper anchor), and most importantly, allowing the area of the hand inward of the transverse crease 10 and 11 to move fully downward and outward in the important phase two stage of the grip.

Note: It is not so much the joining in a lower area which reduces the upper hand stress however, as it is the structure itself which allows for the lower joining (explained in the detail). In fact, although previous upper and lower hand anchors could be structurally separate and held in position by a glove, the stability of current lower hand grip 510 and upper hand grip 520 has increased to the extent that separate mounting (see embodiment 500D, FIGS. 9 & 10) is now the preferred embodiment.

BRIEF DESCRIPTION OF THE DRAWINGS

This invention can better be understood by reference to the drawings, provided for exemplary purposes, and in which.

DETAILED DESCRIPTION OF A PREFERRED EMBODIMENT

Figure 1:
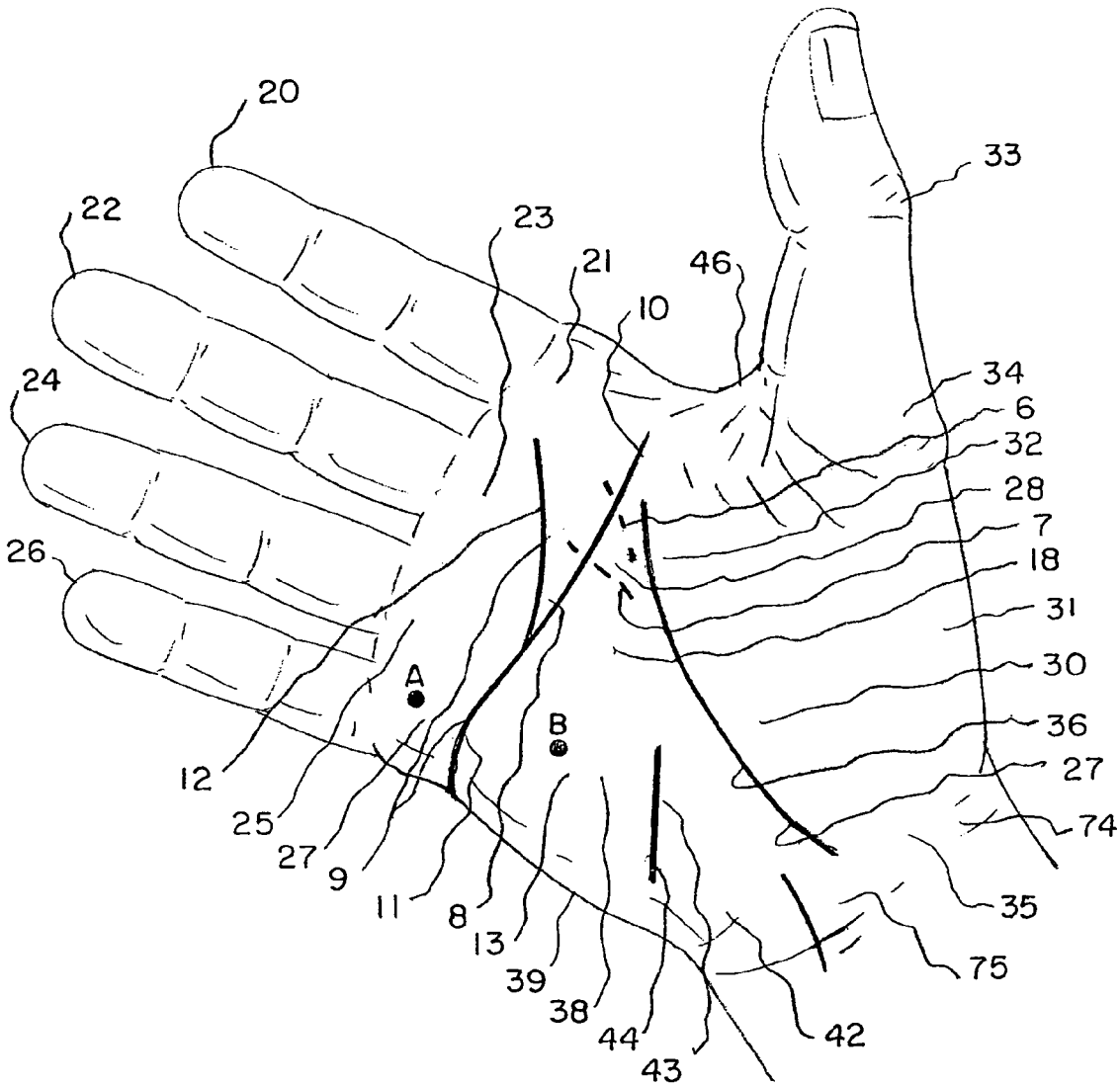
FIG. 1 is an inside view of the palm of a human hand.

There is an area within the hand which acts as a fault line, allowing portions on either side to move in opposite directions (like a loose hinge). In embodiment 400 the line was referred to as a transverse crease running from the inside of the little finger knuckle 27 upward to the top of the hand. This area is important in understanding the gripping motion and will be further named and analyzed as follows: Lower transverse crease 11 extends from the inside of little finger knuckle 27 at the bottom of the hand to ring finger hollow 8, thence becoming outer transverse crease 12 branching (as a "Y") to intersect middle finger 22 and index finger 20. That area acts like a fault line, being the greatest area of movement or "shifting" during phase two of the grip. The portion extending from ring finger hollow 8 upward to the inside of index finger knuckle 21 bordering upper web 46 being upper transverse crease 10. The "fault line" area, the line extending from the base of lower transverse crease 11 to the top of outer transverse crease 12 shall be called shift line 9. Shift line 9 borders the inside of little and ring finger knuckles 27 and 25, and a portion of middle finger knuckle 23.

"Fleshy" areas are areas free of bones and tendons which are good for anchoring such as web areas 32 & 46, and the muscular, lower tough ball area 39. Structure pressing into and moving fleshy areas into better supporting position is referred to as "fleshy relocation". The hand's skin in more sensitive areas such as the sensitive mid-palm 28, lifeline 36 and thumb base 30 may also be pressed in a direction causing some bulking and support (like sliding a thin placemat into a wall), and is referenced "skin relocation" or skin displacement (see "shift line support 10" under "Grip Analysis, phase one"). For directional purposes the areas of hand accessory 500, defined as the upper, lower, outward (or forward) and inward, shall be used to apply to coinciding areas of the hand (see FIG. 1), the hand's upper portion (upper hand) including web areas 32 and 46, thumb base areas 31 and 30 and index finger knuckle 21, the lower portion (lower hand) extending from wrist hollow 75 to ring finger hollow 8 and including the tough ball 38 lower tough ball 39 and fleshy heel 42. Lying midway between the upper hand and lower hand is the cupping mid-palm with an upper portion, sensitive mid-palm 28 composed of middle finger tendon 7 and index finger tendon 6, and a lower more concave portion, less sensitive palm 18 located adjacent ring finger hollow 8 extending inward to exist adjacent and deeper than bony heel 43. (Less sensitive palm 18 is an anchoring area for thin structure of eggshell type strength as in the upper portion of bridge 540). The outward direction (or forward) would be toward the fingers 26, 24, 22 and 20. The outer portion of the hand (outer hand) is outward of shift line 9. The inner portion of the hand (inner hand) is everything inward of shift line 9 including thumb base 30 lower tough ball 39 and everything in-between. Moving or pressing "interiorly" or being "internal" is deeper in the hand. Moving "exteriorly" or being "external" is extending away from the hand. The width of the hand is the distance from top to bottom.

Figure 2:
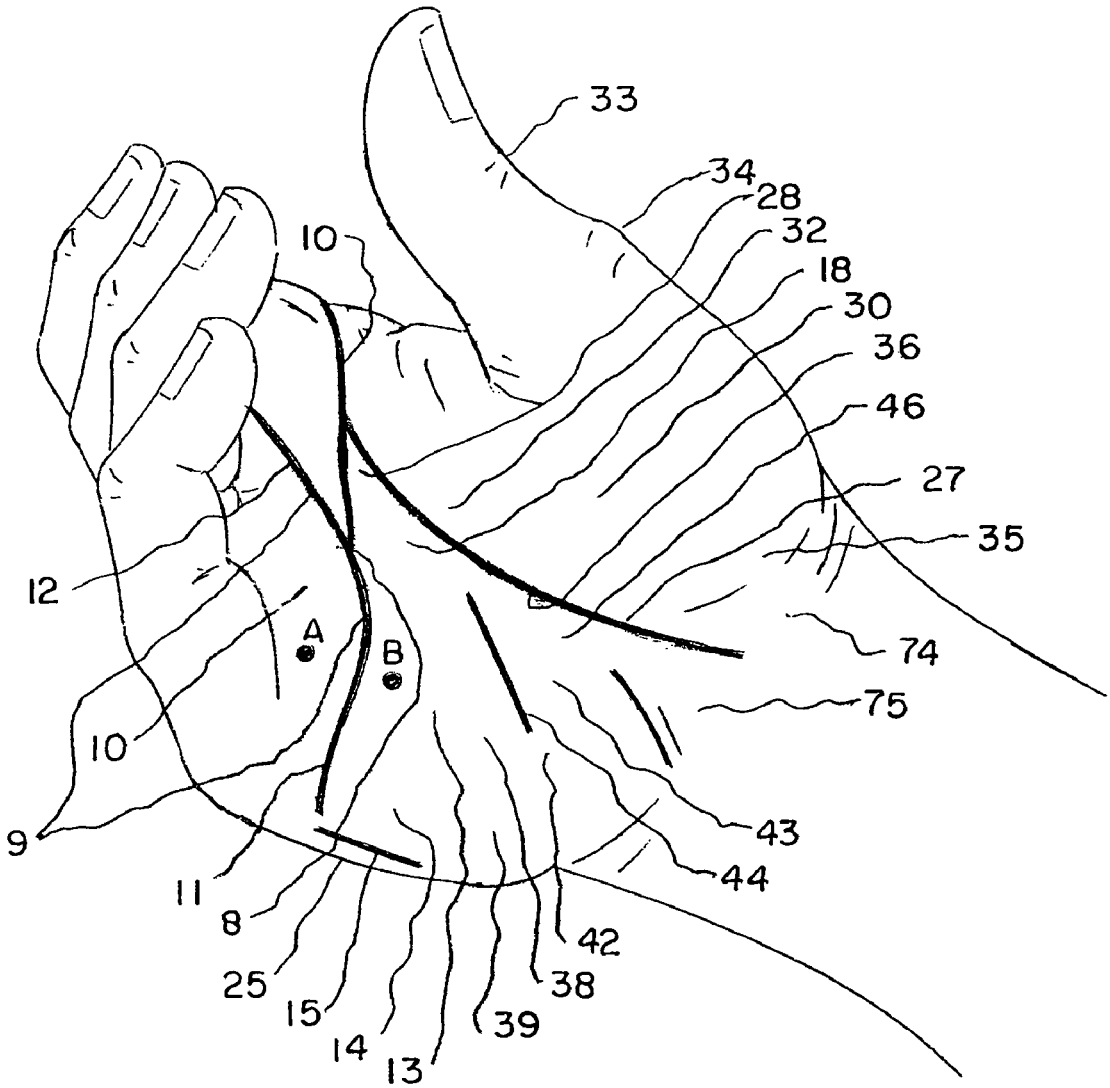
FIG. 2 is an inside view of the palm of the human hand the hand closed to the phase 2 gripping position.

Bordering the upper, inside of sensitive mid palm 28 are the thumb base 30 and lower web 32. Thumb base 30 is the muscular portion of the thumb near lifeline 36, the upper thumb base 31 being nearer thumb second joint 34. Thumb base 30 is bordered outwardly and downwardly by lifeline 36. There is a carpal pocket 35 which can be felt in-between bony lifeline 27 (carpal area) and the middle finger tendon 7 (the area tendon 7 no longer protrudes.) Bordering the lower side of less sensitive palm 18 is tough ball 38 which is the exterior arcing fleshy muscular area inward of little finger knuckle 27 extending almost to the wrist 74. Fleshy bulge 13 is a portion of tough ball 38 bordered outwardly by lower transverse crease 11 and inwardly by heel line 44. Heel line 44 extends upward and outward from fleshy heel 42 at approximately 45 degrees extending to the less sensitive mid-palm 18 adjacent the outside edge of bony heel 43 (hamate bone). As gripping force increases, fleshy bulge 13 expands externally (see FIG. 2, Point B); however, internal pressure on fleshy bulge 13 flattens and presses the lower portion of fleshy bulge 13 to extend lower into the lower tough ball 39, contributing to the relocation of the hand's repositioned fleshy ridge 14. Bordering tough ball 38 downwardly at the bottom of the hand is lower tough ball 39, which is still more tough than tough ball 38 (a better reception area) and the area of primary anchoring contact of hand accessory 500. Within the hand's lower tough ball 39 is primary contact recess 15, a slightly recessed area lying in-between little finger bone 25 and the bottom of lower transverse crease 11 and extending roughly half the distance toward wrist 74. From tough ball areas 38 and 39 the hand extends inwardly to fleshy heel 42 which is adjacent the lower section of lifeline 36. Lying outward (forward) and upward from fleshy heel 42 is a bony heel 43 (hamate bone) which is an exceedingly sensitive area. Directly upward and adjacent bony heel 43 is a bony lifeline 27 (the carpal area). Upward and outward of bony lifeline 27 is carpal pocket 35. Outward of carpal pocket 35 less sensitive palm 18 extends to ring finger hollow 8, which lies between the little and ring finger knuckles 27 and 25 on shift line 9. There is an upper web 46 between thumb 44 and index knuckle 21, and a lower web 32 between index finger tendon 6 and thumb base 30 adjacent lifeline 36. The rear portion of upper web 46 becomes a muscular ridge 47 during phase three and four gripping, creating a noticeable hollow pocket within upper web 46 being web pocket 48 adjacent and forward of muscular ridge 47. Located at the most inward area of lifeline 36 at the wrist is a wrist hollow 75, another tough stress reception area. The area inward of heel line 44 must be allowed to move externally during full grip, as opposed to fleshy bulge 13.

Because descriptions of hand areas and hand accessory structure are similar and may be confusing to the reader, hand descriptions will often be preceded by "the hand's . . . ", such as "the hand's lifeline 36" so as not to confuse with structure.

Gripping hand: All statements regarding the relationship of structure to the hand, such as points of contact and amount of space created by arcing structure, are in reference to a gripping hand at least at phase one, and more accurately reflects the hand at phase two to full grip unless specified.

Figure 6:
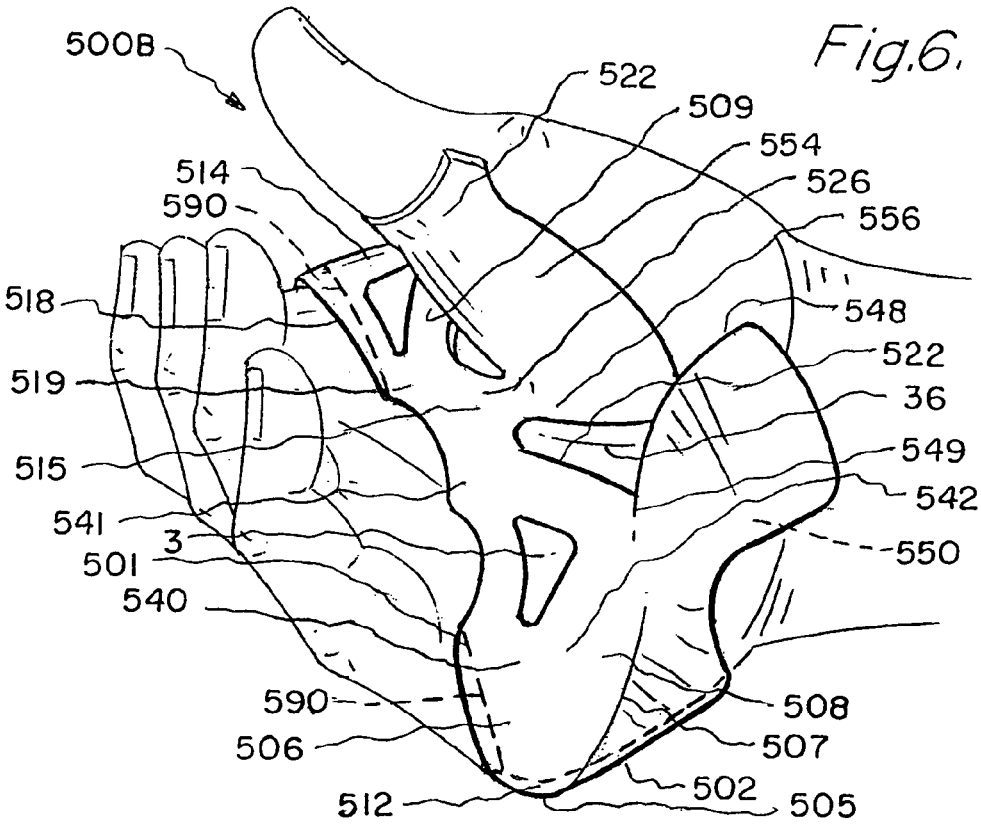
FIG. 6 is a front (exterior) view of the invention in the palm of a human hand, embodiment B, in the phase 1 gripping position.
Figure 8:
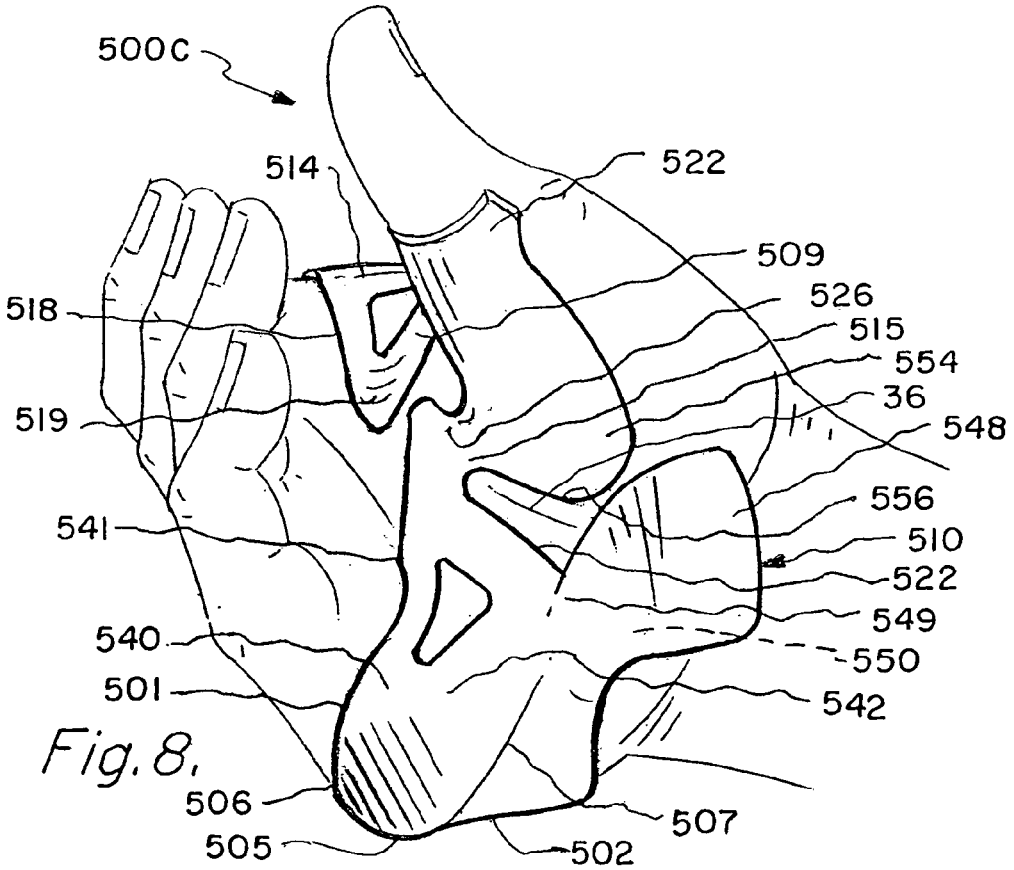
FIG. 8 is a front (exterior) view of the invention in the palm of a human hand, embodiment C, in the phase 1 gripping position.
Figure 9:
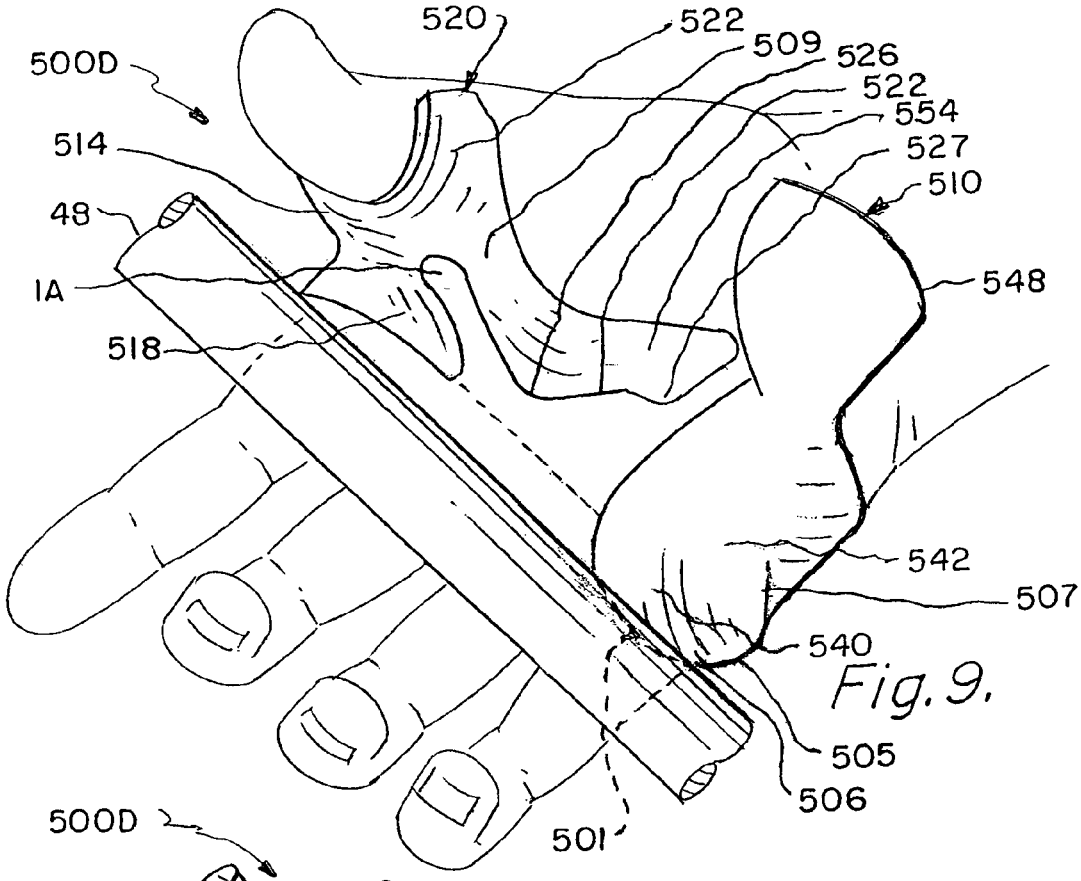
FIG. 9 is a front view of the preferred embodiment, embodiment D placed on a human hand preparing to grip a handle.
Figure 10:
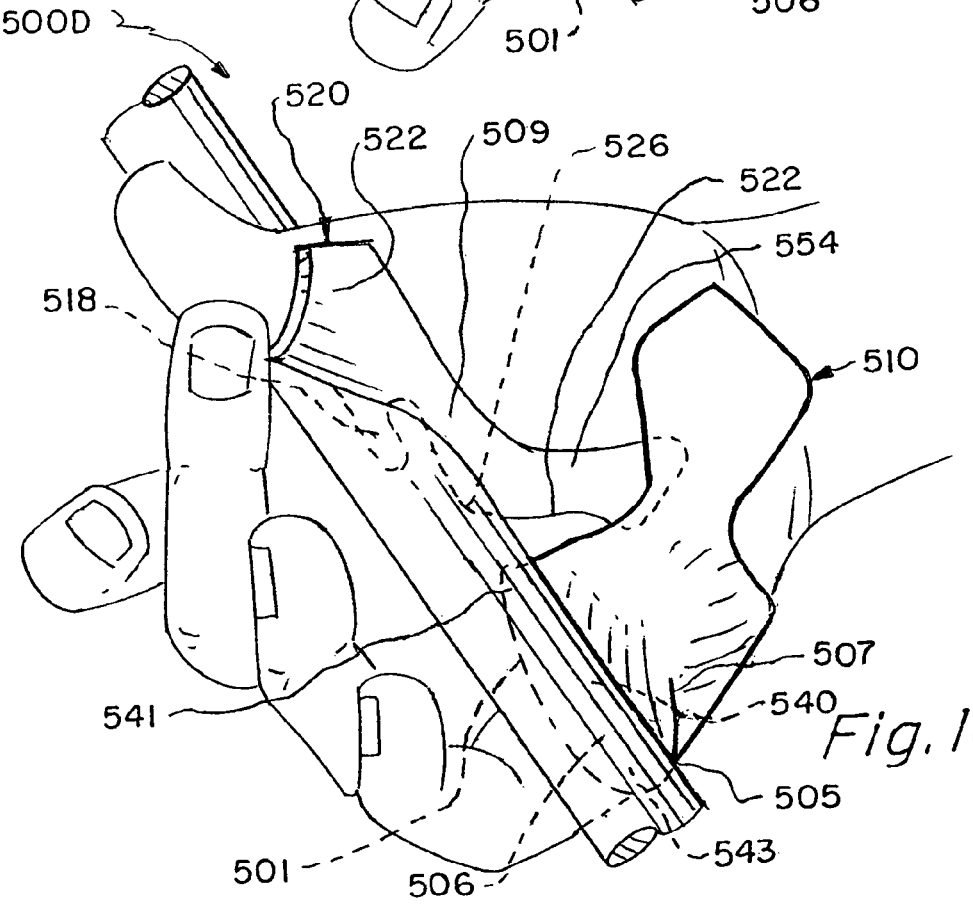
FIG. 10 follows FIG. 9, but with the hand in the phase 2 gripping position.
Figure 11:
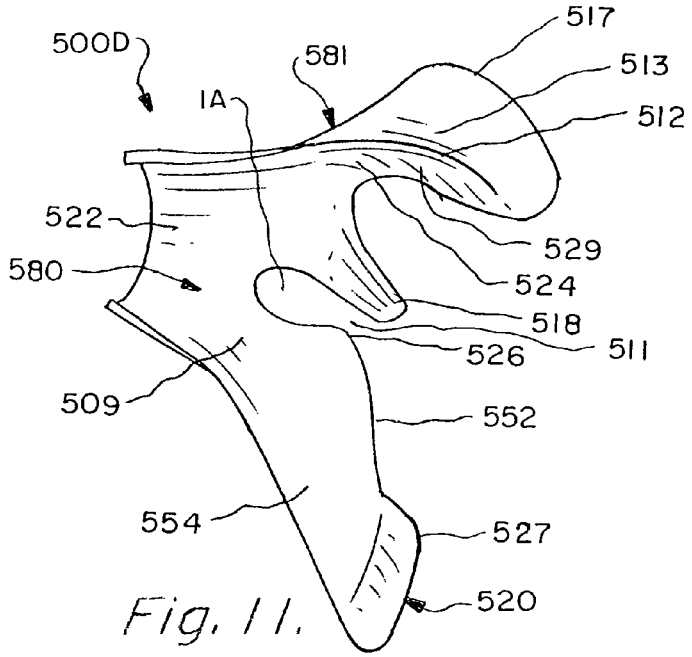
FIG. 11 is a rear, partial side view of the upper hand grip of the preferred embodiment—embodiment D, looking from the inside (thumb area) outward toward the fingers.
Figure 12:
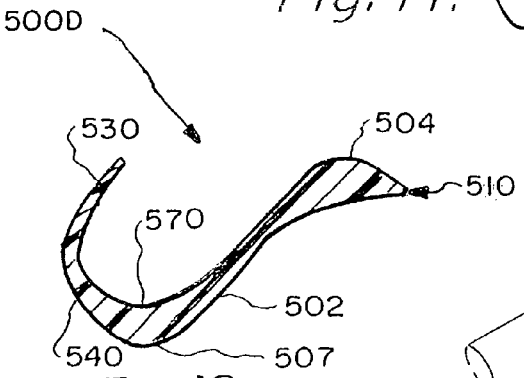
FIG. 12 is a side cross-sectional view of the lower hand grip of embodiments B, C, and D—looking outward at the device from the inside, bottom of the hand.
Figure 13:
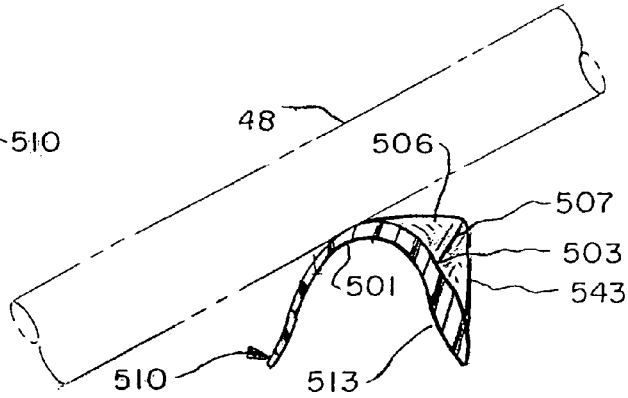
FIG. 13 is a side cross-sectional view of the lower hand grip of embodiments B, C, and D in phase 1 gripping position.
Figure 13A:
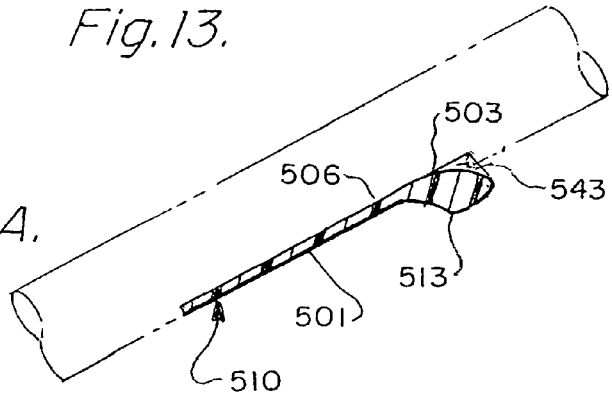
FIG. 13A is a side cross-sectional view of the lower hand grip of embodiments B, C, and D in phase 2 gripping position.

Note: Gripping positions in the artwork show fingers open. The gripping positions are accurate as allowable with fingers left open for better visibility, thus FIGS. 6 & 8 are phase one, FIG. 10 is phase two, and FIG. 9 is an open hand preceding phase one.

Figure 3:
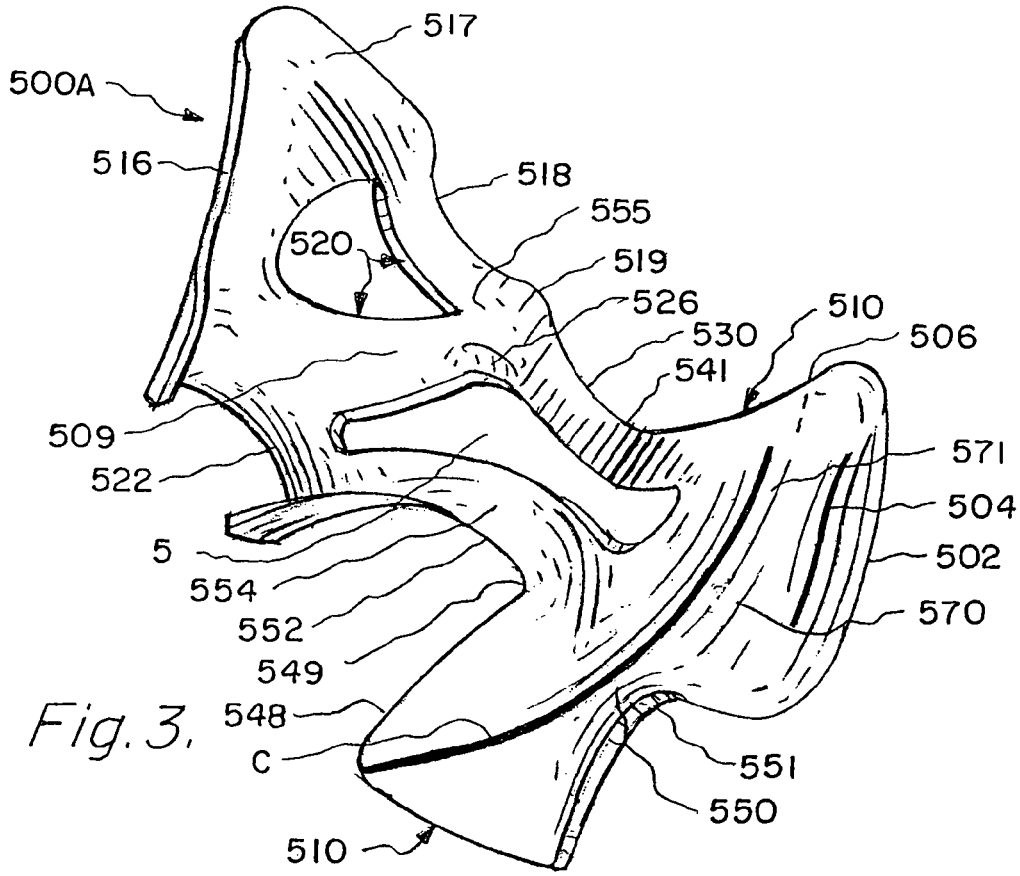
FIG. 3 is a rear (interior) view of the invention, embodiment A.

Embodiment 500A (FIG. 3) has been included not only because it was workable and used by professional ballplayers, but also to demonstrate one of the major steps in the transition from embodiment 400 to improved embodiment 500. Lower hand grips 510 for all current embodiments are very similar, being described in fullest in the detail for embodiments 500B and 500D, with 500D being the preferred embodiment; upper hand grips 520 of embodiments 500A, B and C are very similar, being described in fullest in the detail for embodiment 500B and 500C. Upper hand grip 500D has further improvements over 500A, B and C and is now the preferred embodiment.

Note the similarity of embodiment 500A to embodiment 400, but with an added inner hand space 5 extending from thumb joint anchor 522 to bridge 540. Inner hand space 5 was created by a dissection from thumb joint anchor 522 downwardly through primary contact area 506 ending at fulcrum ridge 504, allowing the inner portion of 500A to be moved downwardly relative to the outer portion and be rejoined at primary contact area 506 allowing full phase two grip (primarily redesigning upper hand grip 520) and partially creating a handle wedge 505 (redesigning lower hand grip 510), handle wedge 505 not fully developed until 500B, (see FIG. 6). A further cut at a downward sloping angle back to front was made along line C (FIG. 3), which shows the internal side of 500A, line C extending from thumb buffer 548 adjacent the lower portion of lifeline 36 outwardly along and being (and partially creating) arcing edge 507 seen externally in FIGS. 6 & 8 ending at primary contact area 506. Structure below line C was then pushed lower and further outward, increasing the size of handle wedge 515 (not yet formed in 500A), and then reattached, further enhancing lower hand grip 510. The lower position also created more space for proper thumb base 30 position in phase two grip (see FIG. 10 embodiment 500D). Note junction 530 is rearward of thumb harness 554 (FIG. 3), conforming to the phase two "clockwise" motion). The larger phase two relocation channel 570 of lower hand grip 510 accommodating the hand's fleshy relocation ridge 14 (not yet apparent in 500A), the further outward position creating handle wedge 515, creating a larger and better angled external arc (widening the effective grip of the hand) and a larger bulge externally at bridge 540. See embodiment 500B for further explanation of the benefits.

Thus, a thin, narrow junction 530 extends from thumb spread 526 and web relocation press 519 downwardly becoming primary contact area 506 of bridge 540. A thin, narrow thumb harness 554 extends from thumb joint anchor 522 downwardly, attaching to an upper edge of bridge 540 at the outside of thumb harness 554, the inside of thumb harness 554 attaching to an upper portion of thumb buffer 548, thumb harness 554 gaining leverage from the hand's thumb base 30 in support of bridge 540. Note FIG. 3, thumb harness 554 being external of junction 530 junction 530 backing up) especially at the area of ring finger hollow 8, their relative positions allowing the described external motion of the inner hand and the internal, clockwise motion of the outer hand.

Figure 5:
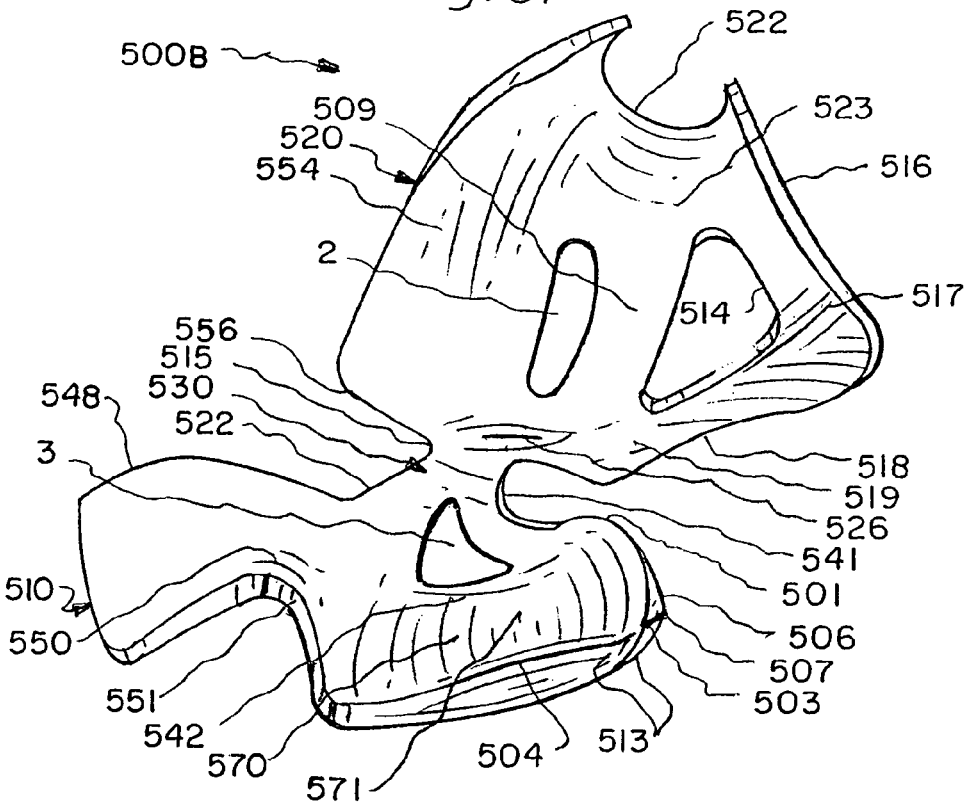
FIG. 5 is a rear (interior) view of the invention, embodiment B.

Embodiment 500B seen in FIGS. 5 & 6 describes by comparison, a much wider and encompassing thumb harness 554 extending to somewhat overlap thumb buffer 548 during certain phases of the grip, (FIG. 6), then angles outwardly to junction 530 such that the inner hand space 5 of 500A is now reduced to upper space 2 and lower space 3.

The phase two relocation channel 570 of 500B is deepened further, not only by the extension of handle wedge 505, but by bridge 540 and primary contact area 506 arcing further externally and downwardly creating handle space 512 below the hand's lower tough ball and also conforming with little knuckle phase two position.

Thus, 500B upper hand grip 520 and lower hand grip 510 are similar to embodiment 500A, however the two anchors are joined by a thin, narrow swivel 515 of basically no length, swivel 515 being the uppermost portion of junction 530. The upper and outermost portion of junction 530 presses into ring finger hollow 8 as ring finger fulcrum 541, thence inward becoming swivel 515 extending across sensitive mid-palm 28 to lifeline 36 and being the inside edge of junction 530 extending downwardly and somewhat inwardly along heel line 44 as lifeline anchor 522, thence arcing externally above bony heel 43 connecting with thumb buffer 548. The outside edge of junction 530 at ring finger fulcrum 540 extends downwardly and somewhat outwardly, becoming the outside edge of a bridge 540 outward and external of lower transverse crease 11, bridge 540 contouring little finger knuckle 27 in little knuckle phase two position. Bridge 540 extends inward to a fleshy bulge anchor 542 resting against the hand's fleshy bulge 13, thence extending inward to lifeline anchor 552 (being the described inside edge of junction 530) arcing internally at the hand's heel line 44 just above bony heel 43 during phase one however anchoring close to the hand's lifeline 36 in carpal pocket 35 as thumb base 30 moves outward during the gripping motion and palm skin moves inward bulking the palm skin into lifeline 36 serving to pad the middle finger tendon in that area. The lower, integrally joined portion of bridge 540 and fleshy bulge anchor 542 arcs exteriorly from an integrally joined lever 508. Lever 508 extends between little finger knuckle 27 and heel line 44. The integrally joined upper portions of bridge 540, fleshy bulge anchor 542 and lifeline anchor 552 narrow and arc inwardly to anchor within less sensitive palm 18 adjacent and below swivel 515, supporting swivel 515 above sensitive mid-palm 28 and being inward and integral to ring finger fulcrum 541. The most upper portion of swivel 515 being thumb spread 526. The upper end of the inner edge of lifeline anchor 552 extends upwardly exteriorly and above index finger tendon 6 (when hand 2 is in full grip) to the inner portion of swivel 515 resting against lifeline 36 (during full grip), the outer edge of swivel 515 suspended externally of middle finger tendon 7, swivel 515 bridging over and braced externally of sensitive mid-palm 28 by the following: the inner edge of swivel 515 at the hand's lifeline 36, lifeline anchor 552, fleshy bulge anchor 542, ring finger fulcrum 541, and additional structure in upper hand grip 520 (described following) which harnesses movement and fleshy displacement in support of swivel 515. A lower space 3 may exist in the lower portion of junction 530 for increased flexibility.

The area of the most direct handle contact beginning at phase one is tangent line 590 (FIG. 6) located at a lower area of bridge 540 and primary contact area 506 within lower hand grip 510 and at outer web anchor 518 within upper hand grip 510.

Upper hand grip 520 (FIGS. 5 & 6): The outer edge of a lower web relocation press 519 extends from the outer edge of swivel 515. The inner, upper edge of lower web relocation press 519 extends from thumb spread 526. Lower web relocation press 519 extends outwardly and upwardly to just past upper transverse crease 10, thence turning upwardly as a thin strip, outer web anchor 518, extending along the upper transverse crease 10 with minor contact at upper web 46, but was previously named "web anchor" because it was the most important discovered structure in the upper hand allowing all the benefits which were and still are derived from other structure in the upper hand. Outer web anchor 518 extends to an upper web relocation press 517 at the back of the hand, anchoring (pushing down with pressure from an external glove) against the upper web 46 at the back side of the hand.

The upper edge of a thumb harness 554 extends from thumb spread 526. The lower edge of thumb harness 554 extends from the outer edge of swivel 515. Thumb harness 554 extends inwardly adjacent lifeline 36 toward the wrist and is also called a thumb base lever 556 at that portion. Thumb base lever 556 supplies lifting force through swivel 515 to ring finger fulcrum 541 aiding in bridging sensitive mid-palm 28. Thumb harness 554 widens and wraps upwardly to enclose much of thumb base 30 and 31 ending above thumb second joint 34, thence wrapping around the underside of the thumb as a thumb joint anchor 522 between second joint 34 and first joint 33 ending at a thumb junction 523 just above the upper web 46 in line with the highest ridge of upper web 46 when the hand's thumb and index finger are stretched apart. The lower edge of thumb base lever 556 of thumb harness 554 anchors along the lifeline capturing energy and fleshy displacement, but does not restrict forward movement of the thumb since there is now a separation between the thumb/lifeline material (thumb harness 554) and bridge 540. Extending from upper web relocation press 517 along the upper and outer portion of the thumb is a thumb/handle spacer 516 joining thumb joint anchor 522 at thumb junction 523. The forward portion of thumb/handle spacer 516 has some leverage against handle 46, thereby becoming a thumb lever 514. Extending from thumb joint anchor 522 downwardly and outwardly is a deflector 509 joining web relocation press 519, creating two spaces, a space 1 enclosed by outer web anchor 518, thumb lever 514 and deflector 509, and a space 2 enclosed by deflector 509, thumb joint anchor 522, thumb harness 554, (with thumb base lever 556) thumb spread 526 and web relocation press 519.

Note: Thumb spread 526, unlike web point 426 of lifeline/web anchor 425 of embodiment 400, does not press into the hand's lower web 32 in phase one position of the hand. Rather, anchoring contact is made only when the thumb has moved downward and partially outward during phase two and three and when the recoiling handle 48 is pressing against lower web relocation press 519. The current larger, re-angled thumb harness 554 now relocates the fleshy exterior of thumb base 30 outwardly, deflector 509 relocates the hand's lower web 32 downwardly, all in support of thumb spread 526 wedging swivel 515 externally away from sensitive mid-palm 28. This is in conjunction with thumb base lever 556 anchoring at lower thumb base 30 adjacent lifeline 36 and stabilized by ring finger fulcrum 541 at ring finger hollow 8 having lifting force at swivel 515 aiding in bridging sensitive mid-palm 28.

Lower hand grip 510 (FIGS. 5 & 6): Lever 508 arcs externally as viewed from every angle. The lowest portion of lever 508, arcing edge 507, is a somewhat thickened edge arcing downwardly (externally) along the full length of lever 508 below the hand's lower tough ball 39. The outermost portion of lever 508 and lower portion of bridge 540 is a primary contact area 506 having an arcing outer edge wrapping around little finger knuckle 27, the highest (most external) point being an upper apex 501. Primary contact area 506 extends from little finger knuckle 27 downward and inward just over the outer lower corner of fleshy bulge 13 to a handle wedge 505. Arcing edge 507 extends from the lowermost outer edge of primary contact area 506 to the hand's fleshy heel 42. The outer edge of primary contact area 506 rests snugly against the lower portion of little finger knuckle 27 outward of lower transverse crease 11, wrapping and enclosing a fleshy portion of little finger knuckle 27, extending upwardly to upper apex 501, thereby becoming the outside edge of bridge 540, then angling inwardly, (and interiorly with hand closed), to ring finger hollow 8. The inner portion of primary contact area 506 extends externally (bridging over) the lowest portion of lower transverse crease 11 not touching the hand's tough ball and lower tough ball 38 and 39 in that area before phase one. Arcing edge 507, exterior of and below lower tough ball 39, joins fulcrum platform 502 at roughly a right angle, fulcrum platform 502 wrapping around the hand's lower tough ball 39 serving as the primary anchoring area of lower hand grip 510. The connection of bridge 540 and fulcrum platform 502 at arcing edge 507 creates an internal space (handle space 512) between the hand and arcing edge 507, the largest portion of handle space 512 being at relocation point 571 interior of handle wedge 505. Primary contact area 506 wraps rearwards joining fulcrum platform 502. Although there is some dispersion of force from handle 48 due to a slight cushioning of the handle or wrapping of the handle by the hand and hand accessory 500, precisely the most direct receiving area is tangent 580, bisecting primary contact area 506. Because the hand's tough ball area 39 leads in swinging a bat, primary contact area 506 (when swinging a bat) also receives the greatest force from handle 48, dispersing that force primarily to the hand's lower tough ball 39 through fulcrum platform 502, and secondarily to the mid-portion of fleshy bulge 13 through fleshy bulge anchor 542, ring finger hollow 8 through ring finger fulcrum 541, less sensitive palm 18 through the upper portions of bridge 540 fleshy bulge anchor 542 and lifeline anchor 552, wrist hollow 75 through thumb/wrist anchor 550 and areas of the thumb base 30 and 31 and web 32 and 46.

The lowest point of arcing edge 507 at its exterior side of hand accessory 500 is handle wedge 505. Handle wedge 505 is just inward of tangent 522. Handle wedge 505 extends approximately half an inch below the hand's lower tough ball 39 before handle pressure is applied. The angle of attachment between arcing edge 507 and fulcrum platform 502 at the outer area of handle wedge 505 is more acute than at the inner area (though not in appearance due to the external arc of bridge 540 from handle wedge 505 to upper apex 501), serving to supply fulcrum platform 502 with greater anchoring force, as well as other benefits of support, force dispersion and stability. Below (interior of) handle wedge 505 at the edge of fulcrum platform 502 is a thickened area, fulcrum ridge 504, pressing into the hand's primary contact recess 15. Fulcrum ridge 504 is the main anchoring area of fulcrum platform 502 remaining fixed in the hand's primary contact recess 15 and acting as a fulcrum during every phase of hand movement as described above. Lever 508 and bridge 540 rise up (externally) behind (inward of) handle 48 in relation to primary contact area 506 being depressed slightly by handle 48, especially during phase two. The lowest portion of primary contact area 506 does not contact handle 48 until phase two of the grip, primary contact area 506 and handle wedge 505 providing powerful gripping force on handle 48 primarily during phase one and two, and also, in combination with underlying supporting structure, serving to widen the effective grip of the hand. The external arc of handle wedge 505, the apex of arcing edge 507, extends to upper apex 501 at the highest arcing point of bridge 540 adjacent little finger knuckle 27. Without handle pressure there is an arc extending between handle wedge 505 and upper apex 501, such that a cushion effect is created under handle pressure with upper apex 501 and the portion of bridge 540 just upward of upper apex 501 rising more externally than handle wedge 505 (as primary contact area 506 depresses into handle space 512) providing the proper angle of support inward and upward of handle 48 to distribute the greatest possible force (or stress) into the lower tough ball 39, thus reducing stress to upper, weaker areas of the hand. The above combined structure provides cushion against the upward inertia of a baseball bat being swung, thereby preventing lower hand grip 510 from being forced upwardly out of position and preventing any portion of lever 508 or arcing edge 507 from impinging upon any sensitive hand areas or blocking any lower area of the hand from moving fully into phase two and on into full grip. The stability is such that lower hand grip 510 within a glove remains in the proper position without additional bracing from upper hand grip 520, and may exist with no upper hand anchor, or, the upper and lower areas of hand accessory 500 separated at swivel 515 may function separately within a glove as in embodiment 500D.

Fulcrum ridge 504 extends inwardly adjacent little finger bone 25 thinning near the lower inner edge of fulcrum platform 502 to the hand's fleshy heel 42, fulcrum platform 502 turning at a right angle upwardly enclosing fleshy heel 42 and joining the lower, forward portion of a thumb buffer 548 just below bony heel 43 at a slightly greater than ninety degree angle, allowing greater glove pressure to be received at the inner area of fulcrum platform 502 serving to press internally (upwardly) carrying pressure to the outer more important anchoring area of fulcrum platform 502.

Thumb buffer 548 is a flat, somewhat square structure resting against the hand's thumb base 30. The lower edge in the forward area of thumb buffer 548 connects with fulcrum platform 502 just below the hand's bony heel 43 at lower connection 551. Lower connection 551 thickens extending inwardly at the lowest portion of lifeline 36 to a thumb/wrist anchor 550 resting against wrist hollow 75, thinning extending upwardly along thumb base 30 to upper thumb base 31, then forwardly, extending externally of thumb base 30 connecting with the inner end of lever 508 above the bony heel 43 at upper connection 549.

The inner edge of lifeline anchor 552 does not extend directly to arcing edge 507 of lever 508 as does bridge 540 and fleshy bulge anchor 542. Lifeline anchor 552, arcing internally and pressing into the hand's heel line 44 arcs away from the hand at its lower end to upper connection 549, a perpendicular connection with thumb buffer 548 and lever 508 just above bony heel 43 roughly half an inch above lower connection 551, the space between connections 549 and 551 arcing externally above bony heel 43, the above structure all serving to anchor lower hand grip 510 above the sensitive bony heel 43 (hamate bone), bony lifeline 27, sensitive mid-palm 28, as well as stabilizing lower anchor 510 to ensure proper distribution of force.

The interior area of arcing edge 507 is phase two relocation channel 570, which provides space for phase two movement (FIG. 2, point B) and fleshy relocation. The deepest portion of phase two relocation channel 570, at the connection between lever 508 and fulcrum platform 502, is relocation point 571, interior of handle wedge 505. Relocation channel 570 allows full phase two movement and provides a space to be filled by repositioned fleshy ridge 14, the hand's repositioned fleshy ridge 14 created by interior arcing of fleshy bulge anchor 542 under pressure of handle 48 forcing tough ball 38 downward, and created by ridge fulcrum 504 pressing into the hand's primary contact recess 15 in combination with pressure from surrounding anchoring areas of fulcrum platform 502 forcing the fleshy surface of lower tough ball 39 upwardly, both relocated fleshy areas being compacted into repositioned fleshy ridge 14, bracing but not totally filling phase two relocation channel 570, and widening the effective grip of the hand.

Figure 7:
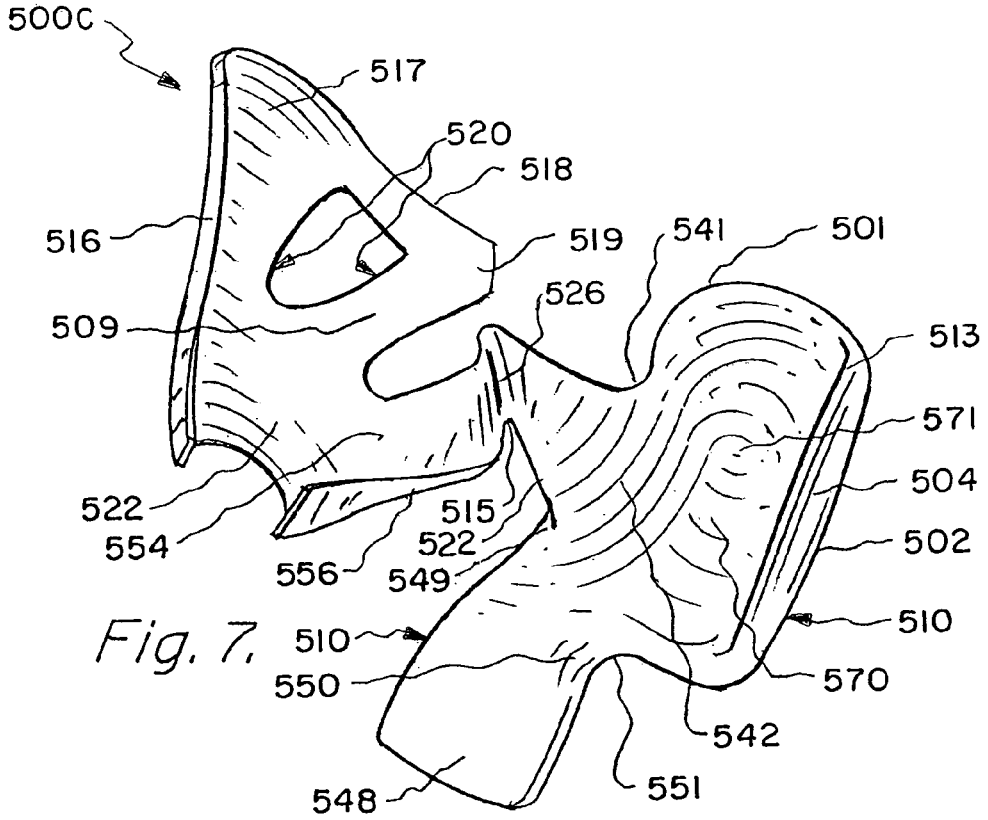
FIG. 7 is a rear (interior) view of the invention, embodiment C.

Embodiment 500C (FIGS. 7-8) is the same as embodiment 500B, with a separation below outer web anchor 518 just above thumb spread 526, which becomes an extended thumb spread 526 functioning as a combined thumb spread 526 and lower web relocation press 519. The upper portion of lower web relocation press 519 combined with deflector 509 and outer web anchor 518 is free to lift externally and outward of index tendon 6 providing more space for the hand's upper web moving downwardly as the thumb moves forward especially during phase three and four, embodiment 500C providing added flexibility and comfort eliminating stress at the thumb muscle and third joint, and leading to embodiment 500D, wherein outer web anchor 518 is separate from thumb spread 526 and deflector 509, deflector 509 and thumb harness 554 becoming more as one body (see following.

Figure 4:
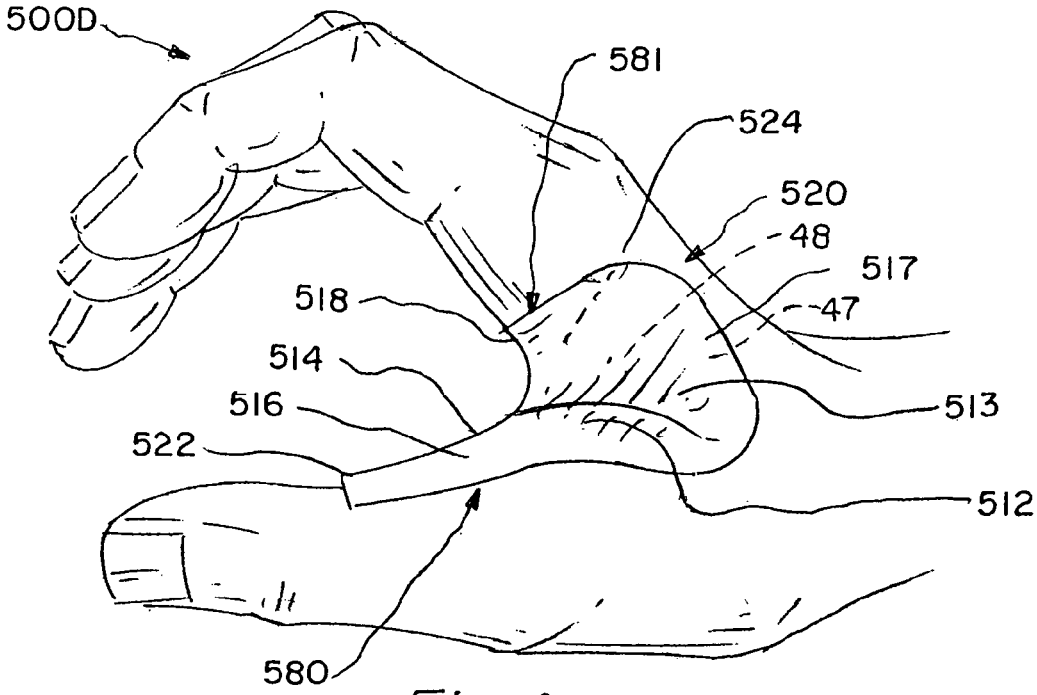
FIG. 4 is a top view of the invention, embodiment D.

Embodiment 500D (FIGS. 4 & 9) consists of two structures, lower hand grip 510 in the lower hand, and upper hand grip 520 in the upper hand. Lower hand grip 510 and upper hand grip 520 may be permanently fixed within an external glove or placed in position on the hand, pulling the glove over the hand, remaining in proper position with no attachment. Lower hand grip 510 and upper hand grip 520 are spaced apart at a distance that fluctuates between close and touching or overlapping in phase two, to a distance of a quarter to half inch in phase three. Prior embodiments were connected to increase stability and distribute stress over a broader area; however, because current embodiment 500 has improved stability, it has been determined that separation is of greater benefit, allowing the described clockwise phase two movement wherein the inner hand is allowed to move downward and outward while the outer hand is moving rearward with no restriction on either area.

The uppermost portion of lower hand grip 510 is buffer 541 pressing into and above ring finger hollow 8 and partially overlapping shift line support 10, buffer 541 extending downward and inward pressing into less sensitive palm 18, thence arcing upwardly above the hand's bony heel 43 to connect with thumb buffer 548 at upper connection 549. The outside edge of buffer 541 extends downwardly and somewhat outwardly, being the outside edge of bridge 540 outward and external of lower transverse crease 11, bridge 540 arcing externally contouring little finger knuckle 27 in little knuckle phase two position. The uppermost outside edge of bridge 540 resting against little finger knuckle 27 being an upper apex 501 (FIG. 14), the outside edge of bridge 540 extending downwardly from upper apex 501 as the outside edge of primary contact area 506, the outside edge wrapping downwardly and internally (hooking) to a recess junction 503, a thickened area due to convergence of primary contact area 506, fulcrum ridge 504 and arcing edge 507. The outside edge at recess junction 503 turns inwardly extending along the little finger bone 25 as the outside edge of fulcrum platform 502, thence turning upwardly and externally at the fleshy heel 42 ending at a lower connection 551. Adjacent the outside edge of fulcrum platform 502 at the interior side (rear of 500D), a thickened area, fulcrum ridge 504, presses into the hand's primary contact recess 15.

Figure 14:
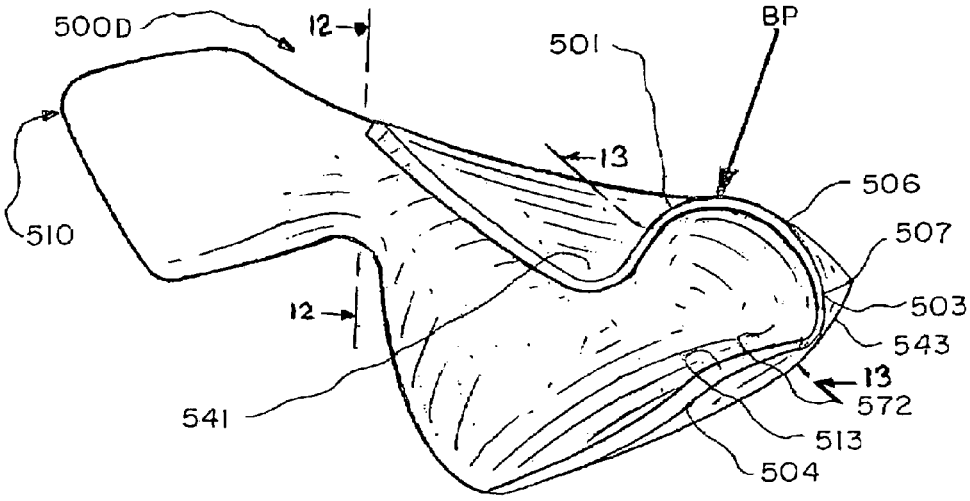
FIG. 14 is a rear (interior) view of the lower hand grip of the preferred embodiment—embodiment D—in the phase 1 gripping position, "BP" indicating bat handle pressure.
Figure 14A:
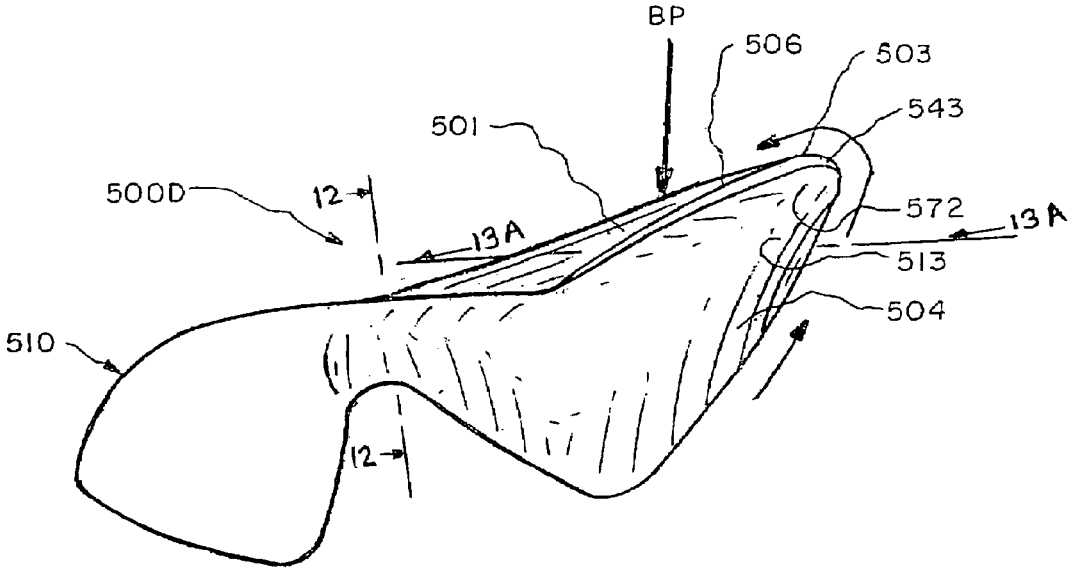
FIG. 14A is a rear (interior) view of the lower hand grip of the preferred embodiment—embodiment D—in phase 2 gripping position, "BP" indicating bat handle pressure.

The outermost portion of fulcrum ridge 504 adjacent recess junction 503 is primary fulcrum point 513. The arc of arcing edge 507 and bending at anchor flex 572 (described later) causes recess junction 503 to hook the fleshy portion of little finger knuckle 27 just outward of lower transverse crease 11 creating stability and aiding primary fulcrum point 513 in pressing into the hand's primary contact recess 15 causing primary fulcrum point 513 to be felt as the main anchoring area of fulcrum platform 502. The outer portion of arcing edge 507 is somewhat widened in relation to handle wedge 505, the lower portion thereabouts being a primary contact extension 543, located below primary contact area 506 and just above the internal primary fulcrum point 513 at the proper angle for distribution of force to the hand's lower tough ball 39. A thinned anchor flex 572 extending from the deeper relocation channel 570 in-between the thickened area of recess junction 503 and primary fulcrum point 513 allows a bending to occur which is a major contributor in the upward, external rotation of primary contact area 506 bringing primary contact area 506 fully into contact with handle 48 and drawing up the area below the now flattening arcing edge 507, primary contact extension 543, to also contact handle 48 during phase two (FIGS. 14-14A). The force creating the upward rotation is the inertia of handle 48 upwardly and internally at the arcing edge of bridge 540 pulling primary contact area 506 upwards, and phase two outward movement of the hand's lower tough ball 39 pushing fulcrum ridge 504 forward pushing primary contact area 506 upwards rotating into contact with handle 48. The approximate angle of bat pressure (inertial handle force) is identified in FIGS. 14-14A by the letters "BP".

Arcing edge 507 extends inwardly and slightly upwardly angling from recess junction 503 in the hand's lower tough ball 39 to midway between lower tough ball 39 and tough ball 38 at handle wedge 505 to tough ball 38 by heel line 44 ending at bony lifeline 27 between upper connection 549 and lower connection 551. Arcing edge 507 connects the uppermost area of fulcrum platform 502 with the lowermost area of bridge 540. The lowest point of arcing edge 507 is handle wedge 505. An imaginary line between upper apex 501 and handle wedge 505 defines primary contact area 506 outward and below, and bridge 540 inward and above. The interior side of arcing edge 507 is phase two relocation channel 570. Arcing edge 507 outward of handle wedge 505 begins thickening at primary contact area 506, toward recess junction 503.

The whole area above arcing edge 507 of lower hand grip 510 may be described as a bridge 540, however for descriptive purposes bridge 540 is shown above primary contact area 506 and below buffer 541. Bridge 540 extends inwardly as fleshy bulge anchor 542 and further inwardly to lifeline anchor 522 extending perpendicularly to thumb buffer 548 at connection 549 externally of bony heel 43, from connection 549 lifeline anchor 522 arcing internally pressing into less sensitive palm 18. Bridge 540 arcs externally from primary contact area 506 above lower transverse crease 11, then reverses arcing internally to buffer 541. Arcing less than bridge 540, fleshy bulge anchor 542 presses into the hand's fleshy bulge 13 helping support bridge 540 and primary contact area 506. The highest point of the external arc of bridge 540 is the described upper apex 501. Bridge 540 and primary contact area 506 slope downwardly and inwardly crossing externally over lower transverse crease 11 from the outside edge at upper apex 501 to arcing edge 507. The upper portion of arcing edge 507 and lower portion of bridge 540 is thought of as a lever 508, extending inward from primary contact area 506 to lifeline anchor 522 and connection 549.

A thumb buffer 548 rests against thumb base 30 and wrist 74. Extending from upper connection 549, the upper edge of thumb buffer 548 extends upwardly and inwardly almost to wrist 74, then downwardly to press against wrist hollow 75, thence turning at a right angle outwardly along the lowest portion of lifeline 36 (below bony lifeline 27) to lower connection 551. Just inward of lower connection 551 a thickened area thumb/wrist anchor 550 provides additional anchoring of thumb buffer 548, thumb buffer 548 bracing and supporting lever 508, bridge 540 and all connecting structure, the area between connections 549 and 551 arcing externally over bony heel 43 and supported by thumb/wrist anchor 550 preventing collapse of arcing edge 507 internally against bony heel 43.

Upper hand grip 520, FIGS. 4 & 9-11, 15 & 16) protects the thumb from bruising, reduces stress in the upper hand and lower hand by enhancing the phase two clockwise motion. Preventing of bruising is accomplished by direct absorption of handle force through the structure, and by maintaining the thumb spaced a distance from handle 48. Upper hand grip 520 is composed of a thumb anchor 580 and a web anchor 581, each working somewhat independently when properly connected.

Within thumb anchor 580, a thumb joint anchor 522 partially wraps around the outside and underside of the thumb above second joint 34. A portion of thumb joint anchor 522 extends downwardly and outwardly as a deflector 509 to the hand's lower web 32. Deflector 509 extends as a thumb harness 554 toward the wrist ending in the area of the hand's bony lifeline 27. The outer edge of thumb harness 554 lies adjacent the hand's lifeline 36, the inner edge contours the hand's thumb base 30. The outside edge of thumb harness 554 is a lifeline anchor 522. Lifeline anchor 522 is integral with thumb spread 526, the two anchoring thumb anchor 581 in position and relocating the fleshy lower web 32 upwardly and inwardly under deflector 509 and over thumb second joint 34, serving to brace deflector 509 and protect by cushioning and insulating thumb second joint 34.

Figure 15:
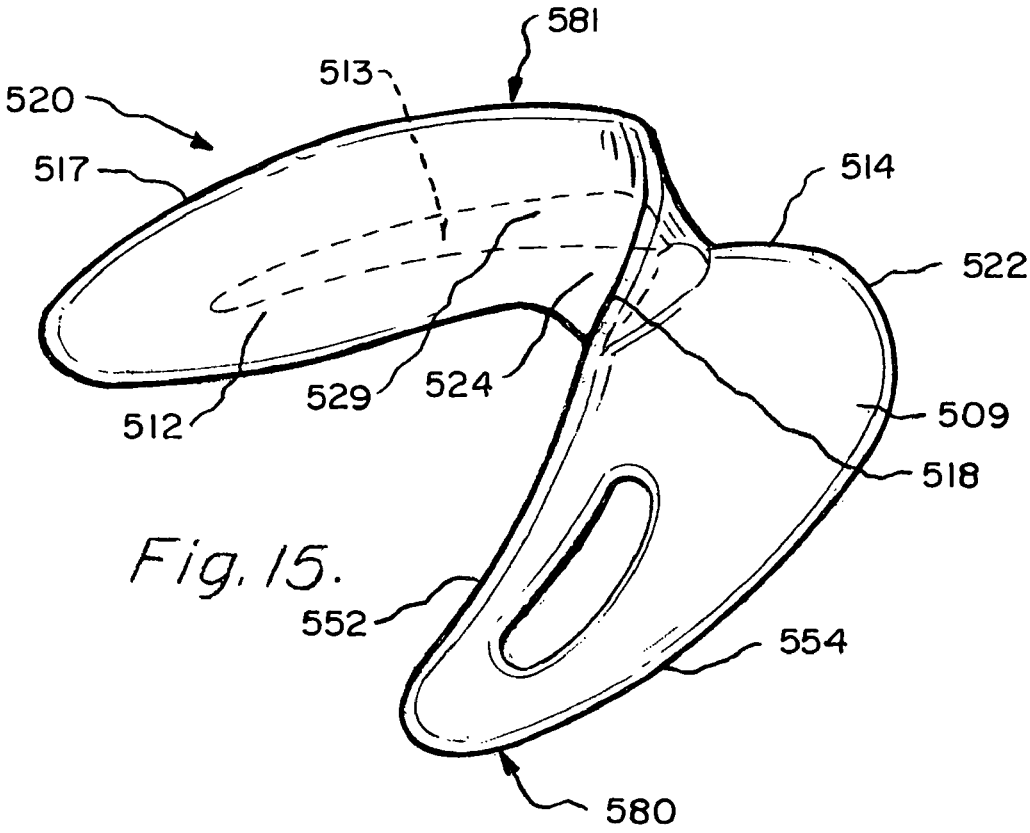
FIG. 15 is a partial side view of the upper hand grip, embodiment D, looking from the outside inwardly and upwardly.
Figure 16:
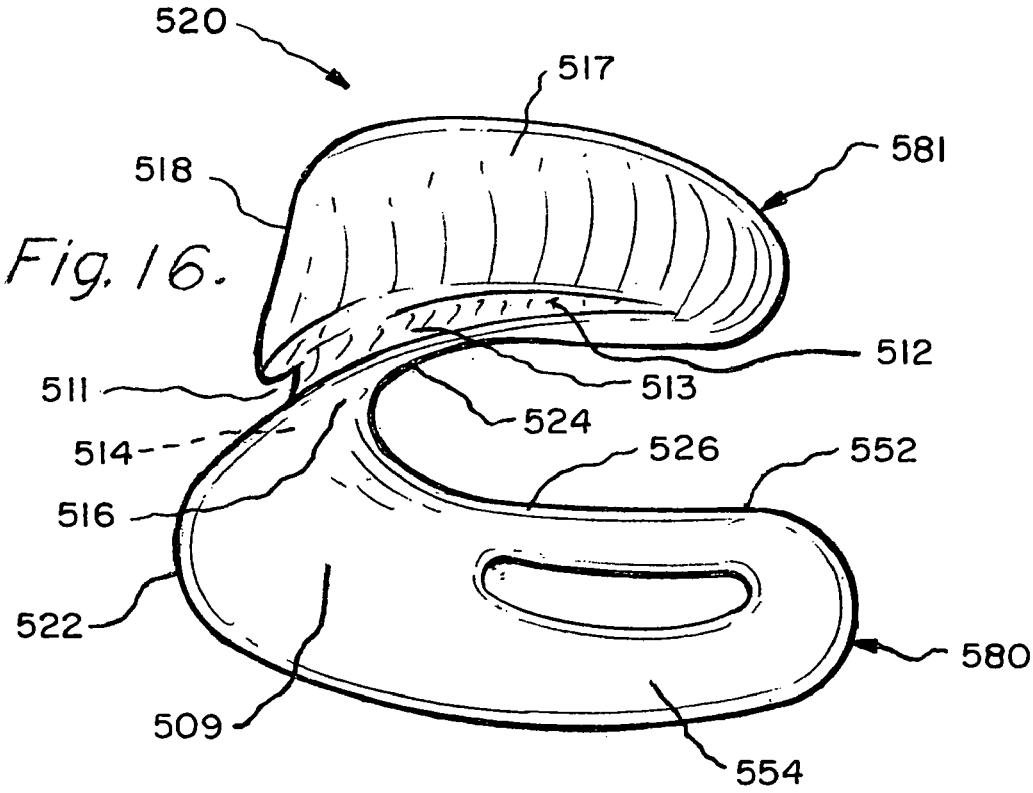
FIG. 16 is a partial side view of the upper hand grip, embodiment D, looking from the inside downwardly and outwardly.

Web anchor 581 is composed of an outer web anchor 518 extending from between index knuckle 21 and middle finger knuckle 23 upwardly along upper transverse crease 10 to the hand's web pocket 48. Outer web anchor 518 may be separate from lifeline anchor 522 (FIG. 11) or connected with lifeline anchor 522 (FIGS. 15 & 16). Within the area of web pocket 48, outer web anchor 518 thickens as a web pocket anchor 529. An upper web relocation press 517 extends rearward at roughly ninety degrees from web pocket anchor 529 and web anchor junction 524, widening, flattening, and thinning at muscular ridge 47. The underside of Upper web relocation press 517 extends from a thin outer edge to a thicker middle area angled somewhat arcing downwardly such that pressure from an external glove creates skin displacement above muscular ridge 47 forwardly and downwardly, and fleshy relocation at web pocket 48 (of upper web 46) downwardly, providing cushioning and support of upper hand grip 520.

Web anchor junction 524 extends forwardly/externally along the thumb as a thumb/handle spacer 516 past thumb second joint 34 to thumb joint anchor 522. Outer web anchor 518 and thumb/handle spacer 516 form a flexible structure and enclose a flexible area which may be an open area (pivot space 1A) between web anchor 581 and thumb anchor 580, or a thinned trough area, trough 513, (see following and FIGS. 4, 15 & 16) between web anchor 581 and thumb anchor 580 extending upwardly and rearwardly, as trough 513 creates a separation 511 between web anchor 581 and thumb anchor 580.

Thumb joint anchor 522 is a thickened area enhancing clearance for the thinner extending deflector 509 over thumb second joint 34 and the muscular thumb base 30, preventing constriction of thumb movement and space for fleshy relocation under deflector 509 in protection of thumb second joint 34, deflector 509 also making partial direct contact with handle 48 especially during phase two and bottom hand gripping (FIG. 10).

The leading edge or external portion of thumb/handle spacer 516 is thumb lever 514 extending between web anchor junction 524 and thumb joint anchor 522. Thumb lever 514 may makes direct contact with handle 48 especially during phase three to four and on inside pitches, serving to further protect thumb second joint 34, the majority of force from the recoiling handle being absorbed in the outside area of the hand between thumb spread 526 and outer web anchor 518.

Thumb joint anchor 522 extends integrally along thumb/handle spacer 516 to web anchor junction 524, and continues on past web anchor junction 524 along the inside edge of upper web relocation press 517. The inside edge of upper web relocation press 517 being a junction ridge 512. Junction ridge 512 contours the outside of thumb knuckle 34 within web pocket 48. The integral connection of web anchor junction 524 and junction ridge 512 (of upper web relocation press 517) being a web pocket anchor 529 filling the hand's upper web 46 bracing upper hand grip 520 against the inertial force of handle 48 and creating support through fleshy relocation of the upper web. Web pocket anchor 529 is a rounded ridge, thin at the area adjacent web anchor junction 524 extending and thickening at an angle of ascent to the outer area of upper web relocation press 519, ascending from within the hand's upper web 46 to the top of index knuckle 21 and muscular ridge 47. Junction ridge 512 descends within upper web relocation press 519 at roughly the same angle as the underlying thumb knuckle (second joint) 34 descends within upper web 46, the descending edge creating a trough 513 which is a portion of web anchor junction 524 and the thin area of web pocket anchor 529. Trough 513 extends parallel with junction ridge 512 from outer web anchor 518 rearwardly, diminishing in the rear area of upper web relocation press 519. Trough 513 provides a separation 511 between thumb anchor 580 and web anchor 581, thus thumb lever 514 being an extension of junction ridge 512 adjacent trough 513 is allowed to move further forwardly and downwardly with less restriction. Trough 513 also allows the index knuckle area of the hand to move inwardly (or roll over) toward the thumb especially important in bottom hand usage. An alternative to trough 513 is an upward extension of space 1A between thumb lever 514 and upper web relocation press 519 creating greater flexibility but less protection to the thumb area. Lower hand grip 510 and upper hand grip 520 may each be used separately, depending on the application.

As another alternate embodiment, either the upper hand grip separately, or the lower hand grip separately, or both upper and lower hand grips together can be attached externally to a thin, fabric type material which fits over the hand as a glove without finger extensions, i.e., a fingerless glove. The hand accessory attached externally to a fingerless glove to be called a base. Once the base is positioned on the hand, an outer glove may be pulled over the base thereby allowing a user to benefit from the hand accessory while using any type or brand of glove.

The illustrations and examples provided herein are for explanatory purposes only and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. In combination with a handle of an implement when said handle is to be manually swung in motion or lifted by the hand of a human with the hand gripping and squeezing said handle, the hand comprising a palm bordered outwardly (or forwardly) by an outside transverse crease extending from between an index finger and a middle finger downward to join a lower transverse crease at a ring finger hollow, the combined creases being a shift line, the shift line bordered outwardly by the knuckles of a little finger, a ring finger and partially the middle finger, the palm bordered upwardly (or above) by a lower web, inwardly by a lifeline contouring a lower thumb base, and downwardly (or below) by a tough ball with a fleshy bulge adjacent the lower transverse crease and a lower tough ball at the lowest area of the hand (bottom) and inwardly from the tough ball a fleshy heel adjacent a wrist, thence upward and outward of the fleshy heel is a bony heel (hamate bone in the carpal area), directly inward of the bony heel at the wrist is a wrist hollow, upward of the lower web is an upper web seen from the rear of the hand, a rear portion of the upper web becomes a muscular ridge during phase three and four gripping creating a noticeable pocket area being a web pocket within the upper web forward of the muscular ridge, the palm composed of a sensitive mid-palm consisting of the index and middle finger tendons and a less sensitive palm (or ring finger trough) being a concave area extending inward from the ring finger hollow to the bony heel and a bony (but tough) lifeline (or lower lifeline) extending to the wrist hollow, a thumb knuckle is known as the thumb second joint, the thumb's area of attachment to the hand at the carpal area being a thumb third joint, within the lower tough ball below the lower transverse crease and above the little finger bone exists a primary contact recess, the area adjacent, outward and slightly upward of the primary contact recess is a fleshy portion of the little finger knuckle which becomes bulky during gripping and further compacted by upward pressure on the lower tough ball, both areas being major anchoring areas, the hand area below the palm being the lower hand, the hand area above the palm being the upper hand, the distance between the top and bottom of the hand being hand width, the hand area outward of the shift line being the outer hand, the hand area inward of the shift line being the inner hand, interiorly or being internal is deeper in the hand, or the hand moving interiorly is rearward toward the back of the hand, moving exteriorly or being external is extending away from the front of the hand, the hand having a grip, the grip moving through different phases in swinging a baseball bat, the bat creating an internal and upward force within the hand known as inertial handle force beginning at the start of the swing being phase one, phase one (or relaxed grip) characterized by partial tightening of the grip with the handle held against the knuckles adjacent or outward of the hand's shift line, a phase two characterized by further tightening outside of the hand's shift line with the inner hand pivoting downward and outward (forward), the lower tough ball tucking partially under the handle with the hand in a more cocked position, the upper hand somewhat tilting and pivoting in a clockwise motion (top hand tilt) attempting to maintain finger control of said inertial handle, the outer hand moving rearward relative to the inner hand, an exception to said phase two clockwise motion being the little finger knuckle attempting to move inward and downward (closing) against said inertial handle force creating a little knuckle phase two position, a phase three wherein the inner hand un-cocks moving forward and upwardly, the upper hand reversing to a counter clockwise motion, the thumb drawing toward the handle reducing space between the handle and the hand, and a phase four or full grip as the hand tightens "accordion-style" to its strongest gripping strength with the inner hand moving forward as little as ⅛ inch further compacting the tendons within the palm, a hand accessory consisting of an upper hand grip in the upper hand and a lower hand grip in the lower hand, the two spaced apart in the area of the hand's sensitive mid-palm, said hand accessory designed to receive force from the pressure of a primarily straight, rounded handle and dissipate said force over a broader area of the hand and channel said force in a greater degree to the lower hand and lesser degree to the upper hand than without said hand accessory, portions of the exterior side of said hand accessory in the receiving area of said handle arcing upwardly and partially surrounding and receiving force from a circumferential area of the handle, however the main line of contact receiving the most direct pressure from said handle being a tangent line, said tangent line extending between a primary contact area within a bridge and an outer web anchor, said primary contact area within said bridge being within said lower hand grip, said outer web anchor being within said upper hand grip, the outer edge of said bridge being adjacent, outward and exterior of the hand's lower transverse crease, a lower portion of said outer edge of said bridge integral with a lower portion of said bridge and extending downward arcing externally of the hand's lower tough ball, said area arcing externally of the hand's lower tough ball being said primary contact area, said outer web anchor resting adjacent the hand's upper transverse crease, the outer (more external) portion of said outer web anchor contouring the index knuckle, the inner portion of said outer web anchor pressing within the outer area of the hand's upper web, the handle resting on said primary contact area and said outer web anchor bridging over the palm of the hand, the handle being braced and cushioned at said tangent line above sensitive joints and tendons of the hand, the combined area of said lower portion of said outer edge of said bridge and said integral lower portion of said bridge arcing downwardly wrapping around the lower tough ball being said primary contact area, said primary contact area located partially below the hand, the interior of said primary contact area (below the hand) being an enclosed space formed by surrounding structure, said enclosed space to be known as a handle space, said outer web anchor thickening at its uppermost area in the hand's upper web angling at roughly ninety degrees to the back of the hand pressing snuggly into the upper web under pressure of an external glove as an upper web relocation press, the lowest portion of said primary contact area being an arcing edge, said arcing edge being the upper edge (most exterior edge) of a fulcrum platform, said arcing edge being the lower edge of a lever integral with said bridge, said arcing edge creating an angle of attachment between said lever integral with said bridge and said fulcrum platform, said lever extending inward to the hand's heel line, said arcing edge arcing exteriorly of (below) the lower tough ball, said fulcrum platform at said angle of attachment extending rearward, interiorly and upwardly toward the back of the hand, said fulcrum platform enclosing the lower tough ball and acting as an anchor and a fulcrum, the interior of said fulcrum platform thickening along and adjacent the rearward edge of said fulcrum platform as a fulcrum ridge, said fulcrum ridge pressing into the hand's primary contact recess anchoring said fulcrum platform and displacing the fleshy, muscular lower tough ball upwardly/exteriorly partially creating the hand's relocated fleshy ridge compacted within a phase two fleshy relocation channel, said relocation channel being the interior of said arcing edge, said fulcrum platform supporting said primary contact area such that the handle at said primary contact area may depress said primary contact area into said handle space without impinging (blocking) phase two movement of the tough ball and inner hand, said surrounding structure of said handle space dispersing said force to the lower tough ball, said lever being an extension of said primary contact area, said lever extending inwardly along the hand's tough ball to the hand's heel line, within said upper hand grip said upper web relocation press extending forward/externally adjacent the thumb past the thumb second joint as a thumb/handle spacer, thence partially encircling the thumb as a thumb joint anchor, a deflector extending downwardly and outwardly from said thumb joint anchor, a thumb harness below, adjacent and integral with said deflector extending downwardly and outwardly from said deflector to the hand's lifeline, said outer web anchor within said upper web relocation press extending down along the hand's lifeline as a lifeline anchor, said lifeline anchor joining said thumb harness.

2. The hand accessory as defined in claim 1 wherein:

said swivel having little length due to widening structure immediately above and below the hand's middle finger tendon, said widening structure anchoring said swivel externally (away from) the hand's sensitive mid-palm, the uppermost portion of said swivel being said thumb spread, said thumb spread being suspended exteriorly of the hand's lower web by said widening structure during phase one, said thumb spread pressing into the lower web during phase two through full grip, such that a partial filling of the hand's lower web inhibits the thumb second joint from drawing closer to the handle, thus creating a more open upper hand while leveraging the muscular thumb base fully downward and outward transferring greater force through the thumb third joint to the lower hand than without said hand accessory.

3. The hand accessory as defined in claim 2 wherein:

said widening structure extending from said inner edge of said swivel at an extreme acute angle creating two extensions almost parallel, the lower said extension being a lifeline anchor, the upper said extension being said thumb harness, said extensions allowing the thumb base to move fully outward and/or downward or downward and internally (sinking).

4. The hand accessory as defined in claim 3 wherein:

a lower/inner edge of said thumb harness extending inwardly from said inner edge of said swivel being a thumb base lever, said thumb base lever adjacent the lifeline, said thumb base lever transferring force through said swivel to said ring finger fulcrum, said thumb harness widening and wrapping upwards past the thumb second joint, thence wrapping around the underside of the thumb as said thumb joint anchor between the thumb second joint and thumb first joint ending at a thumb junction above the upper web, said thumb harness covering a major portion of the hand's fleshy thumb base bracing said swivel externally of the hand's sensitive mid-palm, aiding said thumb base lever in bridging over the sensitive mid-palm.

5. The hand accessory as defined in claim 4 wherein:

said upper hand grip having an outer edge of said lower web relocation press extending from said outer edge of said swivel upwardly and outwardly along the upper area of the lifeline and being pushed just downward and outward of the index finger tendon by the bulking lower web during gripping, the inner edge of said lower web relocation press extending from said thumb spread, the lower portion of said lower web relocation press bracing said swivel externally of the hand's sensitive mid-palm, the upper portion of said lower web relocation press relocating the fleshy lower web inwardly and upwardly towards the thumb second joint serving to cushion and protect the thumb second joint, the outermost portion of said lower web relocation press being adjacent to said outer web anchor, said outer web anchor extending upwardly along the hand's upper transverse crease at said tangent, said outer web anchor resting against the hand's index knuckle adjacent the upper transverse crease providing increased cushion against direct contact with said handle, said deflector aiding surrounding structure in bracing said handle away from the thumb second joint, said triangular structure formed by said deflector, said thumb/handle spacer and said outer web anchor providing strength without buckling or impingement.

6. The hand accessory as defined in claim 3 wherein:

said bridge arcing exteriorly and upwardly from said arcing edge as seen from all angles, the outside edge of said bridge being exterior of the lower transverse crease also allowing the little finger knuckle to close fully inward during gripping, the high arcing of said bridge also maximizing said handle space (increasing the height of said handle space), the highest point of said high arcing being an upper apex at said outside edge of said bridge resting against the little finger knuckle, said bridge reversing to an interior arc pressing into the hand's ring finger hollow as said ring finger fulcrum, said outside edge of said bridge becoming the outside edge of said ring finger fulcrum, said ring finger fulcrum being the lowest portion of said outward widening structure in said lower hand grip, an inner portion of said bridge being a fleshy bulge anchor, said fleshy bulge anchor arcing exteriorly from said arcing edge somewhat less than said bridge, said fleshy bulge anchor reversing to an interior arc somewhat lower and deeper than said bridge, said fleshy bulge anchor pressing into the middle area of the hand's fleshy bulge displacing a fleshy portion of the fleshy bulge lower serving to support said fulcrum platform and widen the grip of the hand, the upper and interior portion of said fleshy bulge anchor integral to said lifeline anchor resting at the hand's heel line, said lifeline anchor being said inward extension from said swivel within said lower hand grip, said lifeline anchor being adjacent and pressing into the hand's lifeline only when the hand movement is close to full grip, the upper portions of said fleshy bulge anchor and said lifeline anchor integral to said bridge being inward of said ring finger fulcrum, said upper portions pressing internally at the hand's less sensitive palm inward of the hand's ring finger hollow and adjacent the bony heel, said upper portions together being a less sensitive palm anchor, said less sensitive palm anchor being an extension of and providing anchoring support for said ring finger fulcrum, the combined said bridge, said fleshy bulge anchor, and said lifeline anchor providing additional leverage in bracing said primary contact area downwardly and exteriorly against the upward/interior said inertial handle force.

7. The hand accessory as defined in claim 1 wherein:

an upper portion of said lifeline anchor being a thumb spread/lower web relocation press, said thumb spread/lower web relocation press also receiving direct contact with said handle along said tangent line, said thumb spread/lower web relocation press enabling a spacing apart of the thumb second joint from the handle and creating leveraging at the thumb third joint increasing the gripping strength in the lower thumb/wrist area and augmenting said phase two clockwise motion, said thumb spread/lower web relocation press creating fleshy relocation upwardly and inwardly supporting said outer web anchor and said deflector serving to cushion the index finger tendon and thumb second joint.

8. The hand accessory as defined in claim 7 wherein:

said thumb spread/lower web relocation press being separate from said outer web anchor.

9. The hand accessory as defined in claim 1 wherein:

a portion of said upper web relocation press at said thickening of said outer web anchor is located in the hand's upper web adjacent and outside the most outside part of the thumb second joint, said portion being a web anchor junction, the top portion of said web anchor junction extending (as said upper web relocation press) at said roughly ninety degrees rearward, thinning, providing a wide, flat surface to be contacted and pressed downwardly by an external glove, thereby bulking and holding the fleshy uppermost outermost area of the hand's upper web adjacent the index knuckle in support of said outer web anchor at said tangent line.

10. The hand accessory as defined in claim 1 wherein:

said arcing edge extending from said primary contact area inwardly and upwardly along the lower tough ball to the hand's fleshy heel, the lowest portion of said lever extending below the hand to said arcing edge creating an internal space similar to said handle space, said internal space being an upper portion of said phase two relocation channel (interior side), said internal space within said relocation channel serving a similar function as said handle space as the lower end of said handle moves inwardly during the swing (especially in bottom hand usage) preventing impingement to the hand and also providing space for an upper portion of the hand's repositioned fleshy ridge partially displaced by pressure at the hand's fleshy bulge, said bridge integral to said primary contact area and said lever extending inwardly to the hand's heel line, said lever and said bridge supplying external force against said handle.

11. The hand accessory as defined in claim 10 wherein:

under pressure of said external glove, said angle of attachment of said fulcrum platform at said primary contact area creates additional pressure at said fulcrum ridge displacing the lowest portion of the lower tough ball (a portion of the relocated fleshy ridge) into said relocation channel, said angle of attachment also helping to create and reinforce said handle space, said angle of attachment of said fulcrum platform at the fleshy heel transferring additional pressure to said fulcrum ridge, said angle of attachment at the fleshy heel being thinner and less angular (more rounded) than said angle of attachment at said primary contact area (the area of said handle wedge) thus allowing the lower portion of said handle or knob of the bat to move inwardly without resistance.

12. The hand accessory as defined in claim 1 wherein:

said lever connecting to a thickened upper portion of a thumb buffer externally of and above the hand's bony heel, said connection being an upper connection, the innermost portion of said fulcrum platform connecting at the lower edge of said thumb buffer at the fleshy heel just below the bony heel at a lower connection, said lower connection thickening extending inward to the wrist hollow as a thumb base/wrist anchor, thence extending upwardly flush with the inside of the lower thumb base and thumb base, thence outwardly exteriorly of the thumb base to said upper connection.

13. The hand accessory as defined in claim 1 wherein:

an outer edge of a swivel located adjacent and exterior of the sensitive mid-palm, the inner edge of said swivel during said gripping being just inward of the sensitive mid-palm, said inner edge of said swivel located adjacent the lifeline during phase two to full grip, said swivel dividing said hand accessory into said upper hand grip and said lower hand grip.

14. The hand accessory as defined in claim 1 wherein:

Within said upper hand grip, said thumb/handle spacer having an outward portion being a thumb lever, said thumb lever having some contact with said handle especially on an inside pitch with extreme phase three grip (on bad swings).

15. The hand accessory as defined in claim 1 wherein:

said outer web anchor being separate from said lifeline anchor.

16. The hand accessory as defined in claim 1 wherein:

said lifeline anchor being separate from said deflector.

17. In combination with a handle of an implement when said handle is to be manually swung in motion or lifted by the hand of a human with the hand gripping and squeezing said handle, the hand comprising a palm bordered outwardly (or forwardly) by an outside transverse crease extending from between an index finger and a middle finger downward to join a lower transverse crease at a ring finger hollow, the combined creases being a shift line, the shift line bordered outwardly by the knuckles of a little finger, a ring finger and partially the middle finger, the palm bordered upwardly (or above) by a lower web, inwardly by a lifeline contouring a thumb base, and downwardly (or below) by a tough ball with a fleshy bulge adjacent the lower transverse crease and a lower tough ball at the lowest area of the hand (bottom) and inwardly from the tough ball a fleshy heel adjacent a wrist, thence upward and outward of the fleshy heel is a bony heel (hamate bone in the carpal area), directly inward of the bony heel at the wrist is a wrist hollow, upward of the lower web is an upper web seen from the rear of the hand, a rear portion of the upper web becomes a muscular ridge during phase three and four gripping creating a noticeable pocket area being a web pocket within the upper web forward of the muscular ridge, the palm composed of a sensitive mid-palm consisting of the index and middle finger tendons and a less sensitive palm (or ring finger trough) being a concave area extending inward from the ring finger hollow to the bony heel and a bony (but tough) lifeline (or lower lifeline) extending to the wrist hollow, a thumb knuckle is known as the thumb second joint, the thumb's area of attachment to the hand at the carpal area being a thumb third joint, within the lower tough ball below the lower transverse crease and above the little finger bone exists a primary contact recess, the area adjacent, outward and slightly upward of the primary contact recess is a fleshy portion of the little finger knuckle which becomes bulky during gripping and further compacted by upward pressure on the lower tough ball, the hand area below the palm being the lower hand, the hand area above the palm being the upper hand, the distance between the top and bottom of the hand being hand width, the hand area outward of the shift line being the outer hand, the hand area inward of the shift line being the inner hand, interiorly or being internal is deeper in the hand, or the hand moving interiorly is rearward toward the back of the hand, moving exteriorly or being external is extending away from the front of the hand, the hand having a grip, the grip moving through different phases in swinging a baseball bat, the bat creating an internal and upward force within the hand known as inertial handle force beginning at the start of the swing being phase one, phase one (or relaxed grip) characterized by partial tightening of the grip with the handle held against the knuckles adjacent or outward of the hand's shift line, a phase two characterized by further tightening outside of the hand's shift line with the inner hand pivoting downward and outward (forward), the lower tough ball tucking partially under the handle with the hand in a more cocked position, the upper hand somewhat tilting and pivoting in a clockwise motion (top hand tilt) attempting to maintain finger control of said inertial handle, the outer hand moving rearward relative to the inner hand, an exception to said phase two clockwise motion being the little finger knuckle attempting to move inward and downward (closing) against said inertial handle force creating a little knuckle phase two position, a phase three wherein the inner hand un-cocks moving forward and upwardly, the upper hand reversing to a counter clockwise motion, the thumb drawing toward the handle reducing space between the handle and the hand, and a phase four or full grip as the hand tightens "accordion-style" to its strongest gripping strength with the inner hand moving forward as little as ⅛ inch further compacting the tendons within the palm, a grip enhancement accessory known as an upper hand grip, said upper hand grip designed to receive force from primarily a straight, rounded handle when lifting an implement or swinging a baseball bat, said upper hand grip designed to prevent bruising of the thumb bone, thumb second joint and index knuckle and relieve stress in the area of the hand extending from the thumb second joint to the wrist without impeding the proper movement of the thumb and inner hand, said upper hand grip reducing stress received in the upper hand and inner hand by aiding said phase two clockwise motion in maintaining finger grip control of said handle, said upper hand grip composed of a thumb anchor and a web anchor, said thumb anchor having a thumb joint anchor partially wrapping around the underside of the thumb between the first and second joint, a portion of said thumb joint anchor extending as a deflector downwardly and outwardly to the hand's lower web, thence turning downwardly as a thumb harness toward the wrist ending in the area of the hand's bony lifeline, the outside edge of said deflector and said thumb harness being a lifeline anchor, a portion of said lifeline anchor being a thumb spread, said enhancement of said clockwise motion gained partially by said thumb spread pressing internally at the hand's lower web wedging between the thumb second joint and index finger tendon creating a spreading without impeding downward, outward movement of the thumb at the third joint and entire inner hand, said lifeline anchor and said thumb spread press, relocating the fleshy lower web upwardly and inwardly under (internal of) said deflector and above (external of) the thumb second joint, said relocated fleshy lower web padding and insulating the thumb second joint and bracing said deflector above the thumb second joint, said deflector and said thumb joint anchor receiving a portion of direct contact with said handle but receiving only minimal stress; said web anchor composed of an outer web anchor, said outer web anchor extending from the lower area of the index knuckle upwardly along the upper transverse crease, said outer web anchor being integral with a thickened structure in the area of the hand's web pocket forward of the muscular ridge at the deepest portion of the upper web, said thickened area being a web pocket anchor, said web pocket anchor relocating a fleshy portion of the upper web downward in support of said outer web anchor, the highest portion of said web pocket anchor extending rearward to the back of the hand as an upper web relocation press, said upper web relocation press being a wide, flat surface, said upper web relocation press thinning at the muscular ridge, said outer web anchor partially supported by said web pocket anchor, said outer web anchor supported by said web pocket anchor absorbing a portion of said inertial handle force primarily at phase three and four, said outer web anchor having a partial separation from said thumb anchor in the area above said thumb spread and below said web pocket anchor, said separation allowing full downward, outward movement of the thumb base preventing impingement to the sensitive mid-palm while still providing support of (tension against) said outer web anchor by said thumb anchor, preventing impingement of the thumb second joint by said outer web anchor under inertial handle force, said outer web anchor also being anchored partially by pressure of the handle at the area of the index knuckle.

18. The upper hand grip as defined in claim 17 wherein:

said web pocket anchor thinning and extending externally as a web anchor junction, said web anchor junction extending along the thumb as a thumb/handle spacer past the thumb second joint to said thumb joint anchor, the combined said areas within said web anchor and said thumb anchor serving to space the thumb second joint away from the handle while providing leverage for transfer of power through the lower thumb base and wrist thereby absorbing more stress (said inertial handle force) in the stronger wrist area and lower thumb base area than the weaker thumb second joint area.

19. The upper hand grip as defined in claim 18 wherein:

said rearward extension of said upper web relocation press extending from said web pocket anchor and said web anchor junction being at roughly ninety degrees to said outer web anchor, said extending externally of said thumb/handle spacer being at an angle which balances support for (applies tension on) said web anchor while allowing that handle contact at said web anchor does not restrain forward movement of said thumb anchor or cause impingement of the thumb second joint during gripping.

20. The upper hand grip as described in claim 18 wherein:

said outer web anchor and said thumb/handle spacer partially enclosing a flexible space, said flexible space being a pivot space, said pivot space being in said area of said separation, said pivot space allowing proper thumb motion without impingement or buckling of said thumb anchor, said outer web anchor and said web anchor junction under said pressure of an external glove and said handle maintaining space between the thumb second joint and the handle enhancing said phase two clockwise motion transferring power to the lower hand through the thumb third joint and reducing stress to the upper hand and inner hand, said pivot space diminishing as said grip moves from said phase one through said phase four, said diminishing closing off and further protecting areas of the thumb second joint.

21. The upper hand grip as described in claim 20 wherein:

said pivot space between said web anchor and said thumb anchor allowing said thumb harness to move with independence of said web anchor, said thumb harness moving downward and forward during phase two, and upward and forward during phase three, said pivot space narrowing during gripping, said pivot space allowing said thumb harness to follow and maintain contact with the hand's thumb base.

22. The upper hand grip as defined in claim 20 wherein:

said thumb spread being crescent shaped arcing somewhat internally from said lifeline anchor.

23. The upper hand grip as described in claim 18 wherein:

the external (leading) portion of said thumb/handle spacer being a thumb lever, said thumb lever extending between said web anchor junction and said thumb joint anchor, said thumb lever, said web anchor junction and said upper web relocation press providing protection to the thumb from bruising on extreme phase three griping on inside pitches (bad swings).

24. The upper hand grip as defined in claim 18 wherein:

said thumb joint anchor and said thumb handle/spacer being integral with said web anchor junction and the inner edge of said upper web relocation press adjacent the outer portion of the thumb second joint within the hand's web pocket, said inner edge being a junction ridge, said junction ridge integral with said web anchor junction integral with said web pocket anchor, said web pocket anchor filling the hand's upper web bracing said upper hand grip against said inertial force of said handle and creating support through fleshy relocation of the upper web, the area between said junction ridge and the outside portion of said web pocket anchor being a trough, said trough being a thinned flexible area, said trough located within said area of said separation, said trough being external to said web pocket anchor, said trough enhancing phase two motion.

25. The upper hand grip as defined in claim 24 wherein:

internally, said web pocket anchor appearing as a rounded ridge extending in an ascent to the outer areas of said upper web relocation press, said web pocket anchor in conjunction with said upper web relocation press under pressure from said external glove serving to block said outer web anchor from moving out of position upwardly and rearward due to said phase two clockwise motion and the hand's forward thumb movement, said outer web anchor in conjunction with said web pocket anchor aiding in maintaining said thumb spread in position and proper angle, said proper angle being the downward angle of the lower web in gripping, said proper angle aiding in proper fleshy relocation and thumb protection while augmenting said phase two clockwise motion and allowing full downward movement of the thumb providing a complete and powerful phase four grip.

26. The upper hand grip , as defined in claim 25 wherein:

said junction ridge having an outer edge descending to said trough within said upper web relocation press, said junction ridge being an extension of said thumb lever, said trough enhancing movement of said thumb lever forwardly, said trough allowing said junction ridge portion of said web anchor to act partially as a portion of said thumb anchor allowing said thumb anchor to move forwardly and downwardly without leveraging said web anchor out of proper position, said trough of said upper web relocation press also allowing the upper/outer hand at the area of the index knuckle to move inwardly in said clockwise motion and (roll over slightly) so that said outer web anchor moves inwardly and exteriorly partially blocking said recoiling handle, and said trough moves outwardly/downwardly away from and allowing clearance for the thumb second joint.

27. The upper hand grip as defined in claim 17 wherein:

said thumb joint anchor located between the thumb first and second joints, said thumb joint anchor being a thickened area such that said deflector is anchored somewhat externally by said thumb joint anchor allowing clearance extending over the thumb second joint and muscular thumb base, said clearance aiding in preventing constriction of the muscular thumb base, said clearance allowing space for said relocated fleshy web under said deflector, said fleshy relocation under said deflector bracing said deflector externally of the thumb second joint against said inertial force of said handle.

28. The upper hand grip as defined in claim 20 wherein:

movement of said thumb harness is enhanced by pivoting at said lifeline anchor adjacent said thumb spread, said thumb harness arcing and extending further externally (bulging) during phase two, said thumb harness making some contact with the handle especially during phase two and in bottom hand gripping, further bracing said handle, absorbing stress in the lower thumb base (adjacent the lifeline) reducing upper hand stress and protecting the thumb from bruising.

29. The upper hand grip as defined in claim 17 wherein:

said lifeline anchor being connected to a lowest portion of said outer web anchor, said separation existing between said lifeline anchor and said thumb harness, said separation widening said thumb harness, said separation providing space for lower web and thumb base fleshy relocation, said thumb harness contouring the hand's thumb base.

30. The upper hand grip as defined in claim 17 wherein:

said upper hand grip is attached externally to a thin, fabric type material which fits over the hand as a glove without finger extensions (fingerless glove), said upper hand grip attached externally to said fingerless glove to be called a base, once said base is positioned on the hand, an outer glove may be pulled over said base allowing a user to benefit from said upper hand grip while using any type or brand of glove desired.

31. In combination with a handle of an implement when said handle is to be manually swung in motion or lifted by the hand of a human with the hand gripping and squeezing said handle, the hand comprising a palm bordered outwardly (or forwardly) by an outside transverse crease extending from between an index finger and a middle finger downward to join a lower transverse crease at a ring finger hollow, the combined creases being a shift line, the shift line bordered outwardly by the knuckles of a little finger, a ring finger and partially the middle finger, the palm bordered upwardly (or above) by a lower web, inwardly by a lifeline contouring a thumb base, and downwardly (or below) by a tough ball with a fleshy bulge adjacent the lower transverse crease and a lower tough ball at the lowest area of the hand (bottom) and inwardly from the tough ball a fleshy heel adjacent a wrist, thence upward and outward of the fleshy heel is a bony heel (hamate bone in the carpal area), directly inward of the bony heel at the wrist is a wrist hollow, upward of the lower web is an upper web seen from the rear of the hand, a rear portion of the upper web becomes a muscular ridge during phase three and four gripping creating a noticeable pocket area being a web pocket within the upper web forward of the muscular ridge, the palm composed of a sensitive mid-palm consisting of the index and middle finger tendons and a less sensitive palm (or ring finger trough) being a concave area extending inward from the ring finger hollow to the bony heel and a bony (but tough) lifeline (or lower lifeline) extending to the wrist hollow, a thumb knuckle is known as the thumb second joint, the thumb's area of attachment to the hand at the carpal area being a thumb third joint, within the lower tough ball below the lower transverse crease and above the little finger bone exists a primary contact recess, the area adjacent, outward and slightly upward of the primary contact recess is a fleshy portion of the little finger knuckle which becomes bulky during gripping and further compacted by upward pressure on the lower tough ball, both areas being major anchoring areas, the hand area below the palm being the lower hand, the hand area above the palm being the upper hand, the distance between the top and bottom of the hand being hand width, the hand area outward of the shift line being the outer hand, the hand area inward of the shift line being the inner hand, interiorly or being internal is deeper in the hand, or the hand moving interiorly is rearward toward the back of the hand, moving exteriorly or being external is extending away from the front of the hand, the hand having a grip, the grip moving through different phases in swinging a baseball bat, the bat creating an internal and upward force within the hand known as inertial handle force beginning at the start of the swing being phase one, phase one (or relaxed grip) characterized by partial tightening of the grip with the handle held against the knuckles adjacent or outward of the hand's shift line, a phase two characterized by further tightening outside of the hand's shift line with the inner hand pivoting downward and outward (forward), the lower tough ball tucking partially under the handle with the hand in a more cocked position, the upper hand somewhat tilting and pivoting in a clockwise motion (top hand tilt) attempting to maintain finger control of said inertial handle, the outer hand moving rearward relative to the inner hand, an exception to said phase two clockwise motion being the little finger knuckle attempting to move inward and downward (closing) against said inertial handle force creating a little knuckle phase two position, a phase three wherein the inner hand un-cocks moving forward and upwardly, the upper hand reversing to a counter clockwise motion, the thumb drawing toward the handle reducing space between the handle and the hand, and a phase four or full grip as the hand tightens "accordion-style" to its strongest gripping strength with the inner hand moving forward as little as ⅛ inch further compacting the tendons within the palm, a grip enhancement accessory known as a lower hand grip, said lower hand grip designed to receive force from primarily a straight, rounded handle when lifting an implement or gripping and swinging a baseball bat, without said lower hand grip when the handle is held in said phase one position against the skin of the knuckles outward of the hand's shift line the handle presses the skin inwardly, compacting the skin into the hand's ring finger hollow, said compaction to be known as shift line support, the described shift line support providing support for the handle without said lower hand grip primarily above the ring finger hollow at the ring finger knuckle increasing the gripping support in the area of the ring finger which although being the hand's weaker finger is felt as a relatively stronger area of the grip when swinging a bat without said lower hand grip, there being less shift line support at the middle finger knuckle, there being almost no support at the little finger knuckle especially in swinging a bat with the little finger leading (the hand moving parallel to the ground), said inertial handle force displacing shift line support upwardly (toward the ring finger knuckle) so that although contact is made at the little finger knuckle, only minor support is gained in that area, meaning little power is transmitted to the handle from any portion of the hand below the midpoint of the little finger knuckle, and no power is transmitted to, or stress receive from, the handle at the hand's lower tough ball, which is the strongest, fleshiest and toughest area of the hand;

the hand with said lower hand grip increasing support and control of the handle in the area below the midpoint of the little finger knuckle and transmitting power to the handle from the lower tough ball, said lower hand grip making handle contact below the little finger knuckle and below the tough ball at a primary contact area after reaching said phase two position, said primary contact area being the lowest portion of a bridge, the outside edge of said bridge contouring a gripping little finger knuckle outward and external of said shift line, initial said handle contact occurring at said outside edge of said bridge during said phase one position while most of said primary contact area is still interior of (not touching) said handle, the outside portion of said bridge extending upwardly and arcing internally to end at the ring finger hollow, the uppermost portion of said bridge pressing into the less sensitive palm, said bridge having an external arc at said contouring of the gripping little finger knuckle conforming to said little knuckle phase two position, the highest point of said external arc at said outside edge of said bridge being an upper apex, an imaginary line in said bridge extending from said upper apex downwardly and inwardly over and external of the lower transverse crease to an arcing edge, said arcing edge being more rearward than said bridge creating a downward angle of tilt of said bridge at the area of said imaginary line, said downward angle of tilt extending from said imaginary line downwardly and somewhat outwardly curving around the little finger knuckle below the hand as said primary contact area, the outside edge of said primary contact area hooking the little finger knuckle fleshy area adjacent the lower transverse crease, said arcing edge arcing externally as viewed lengthwise and widthwise downwardly of the lower tough ball, said arcing edge being the upper edge of a fulcrum platform, said arcing edge being the lower edge of a lever, said lever being the lowest portion of said bridge, said lever being integral and inward of said primary contact area, said lever extending inward to the hand's heel line, said fulcrum platform joining said lever and said primary contact area at a roughly right angle under handle pressure, said fulcrum platform supporting said primary contact area and said lever, said fulcrum platform enclosing the lower tough ball and acting as an anchor and a fulcrum, a fulcrum ridge on the interior side of said fulcrum platform pressing into the hand's primary contact recess, an outer portion of said fulcrum ridge adjacent the inner (interior) edge of said fulcrum platform being a primary fulcrum point, said primary fulcrum point pressing into the outermost portion of the hand's primary contact recess and hooking the fleshy area at the base of the lower transverse crease, a portion of said arcing edge directly below said primary contact area is a primary contact extension, a flattening of said arcing edge and an upward rotation of said primary contact extension occurring during said phase two such that said primary contact area and a portion of said primary contact extension come into direct contact with the handle.

32. The lower hand grip as defined in claim 31 wherein:

said bridge being external of the lower transverse crease between said upper apex and said arcing edge creating a cushioning area for said handle, the area said imaginary line meets said arcing edge being a handle wedge, said handle wedge being the lowest point of said arcing edge (below the lower tough ball), said primary contact area prior to said phase two existing mostly below the hand, said primary contact extension prior to said phase two existing completely below the hand, an interior portion of said primary contact area (below the hand) being an enclosed space formed by surrounding structure, said enclosed space to be known as a handle space, said cushioning area being somewhat effective acting as a spring during straightforward gripping such as lifting barbells or pressing down on a handlebar, said cushioning area being more effective acting as a wedge or brace during said swinging of a baseball bat beginning at phase one, said cushioning area rising externally inward of and in support of said handle as said handle presses internally just below said cushioning area at said primary contact area, said primary contact area depressing partially into said handle space providing proper angle of support inward and upward of the handle distributing the majority of force to the lower tough ball.

33. The lower hand grip as defined in claim 32 wherein:

said surrounding structure forming said handle space being said primary contact area integral with said lever , said handle wedge integral with said arcing edge and said fulcrum platform.

34. The lower hand grip as defined in claim 32 wherein:

said arcing edge extending from the lowest portion of said primary contact area in the lower tough ball inwardly and somewhat upwardly to between the hand's tough ball and lower tough ball at said handle wedge, continuing inwardly and upwardly to the hand's fleshy heel, said arcing edge being somewhat noticeable as an angular edge at said handle wedge, said arcing edge in the area integral with said primary contact area and said primary contact extension being a rounded arc of short radius relative to the inside area of said arcing edge thinning and rounded of longer radius conforming to the tough ball and lower tough ball allowing the lower end of said handle to move inwardly during the swing (especially in bottom hand usage) preventing impingement to the hand, said angular edge at said handle wedge aiding in providing space within said relocation channel for an upper portion of the hand's repositioned fleshy ridge partially displaced by pressure at the hand's fleshy bulge, said fulcrum ridge displacing the lowest portion of the lower tough ball upwardly (externally) into said fleshy relocation channel.

35. The lower hand grip as defined in claim 31 wherein:

the outermost point of said arcing edge at the junction of the outer edge of said primary contact area and outer edge of said fulcrum platform being a recess junction, said recess junction being adjacent said primary fulcrum point, said recess junction hooking the fleshy portion of the little finger knuckle outward and adjacent the hand's lower transverse crease, the interior side of said arcing edge being a recessed area (reverse of said arcing edge), said recessed area being a relocation channel, said relocation channel providing space for the hand's relocated fleshy ridge portion of the lower tough ball, said relocation channel having an outermost area being an anchor flex, said anchor flex angling somewhat below the exterior said arcing edge, said anchor flex extending outward to adjacent said recess junction, said anchor flex allowing a bending to occur during said phase two, the arc of said arcing edge and said bending of said anchor flex aiding said recess junction in hooking the fleshy portion of the little finger knuckle just outward of the lower transverse crease and move somewhat upwardly relocating said fleshy portion in support of said primary contact area, said bending at said anchor flex allowing said primary fulcrum point to remain in position pressed into the hand's primary contact recess, not following said primary contact extension upwardly, said bending allowing said upward rotation to occur during said phase two with said primary contact area and said primary contact extension moving upwardly and externally toward and in support of said handle, also aiding said primary fulcrum point to remain anchored in said primary contact recess is said upper apex, said external arc of said bridge, and said fleshy relocation channel together providing proper location and amount of space for fleshy relocation above and external of said primary fulcrum point, not pushing said primary fulcrum point out of position, the force propelling said upward rotation of said primary contact extension being handle contact pressing internally and upwardly (said inertial handle force) at said upper apex, and said phase two outward movement of the hand's lower tough ball pressing outwardly at said fulcrum ridge and said primary fulcrum point, the combination creating said upward rotation lifting said primary contact extension externally to contact said handle widening the grip of the hand, top hand tilt position of the hand also aiding in moving said primary contact area externally to meet said handle, said primary contact area and said primary contact extension dispersing stress through said fulcrum platform to the tough, fleshy lower tough ball, said downward angle of tilt at said primary contact area stabilizing said lower hand grip against the upward said inertial force of a recoiling or heavy handle, said dispersion of stress from said handle and the transfer of force from the hand enabling said lower hand grip independent stability within an external glove.

36. The lower hand grip as defined in claim 31 wherein:

said uppermost portion of said bridge overlapping said shift line support being a buffer, said buffer acting to limit the upward displacement of said shift line support by reducing the friction of said inertial handle force, said buffer and said external arcing of said bridge over the lower transverse crease providing more shift line support at the little finger knuckle area aiding in widening the supporting grip of said lower hand grip.

37. The lower hand accessory as defined in claim 31 wherein:

said lever and said bridge connecting at a thickened upper portion of a thumb buffer externally of the hand's bony lifeline, said connection being an upper connection, the innermost uppermost portion of said fulcrum platform connecting at a lower portion of said thumb buffer at the fleshy heel as a lower connection, said lower connection thickening extending inward to the wrist hollow as a thumb base/wrist anchor, thence extending upwardly flush with the inside of the thumb base, thence outwardly exteriorly of the thumb base to said upper connection, said thumb buffer arcing from said upper connection to said lower connection externally of the bony heel protecting the bony heel from bruising especially during bottom hand gripping.

38. The lower hand grip as defined in claim 31 wherein:

said bridge arcs exteriorly and upwardly from said primary contact area and said arcing edge as seen from all angles, said outside edge of said bridge being exterior of the lower transverse crease also allowing the little finger knuckle to close fully inward during gripping, the high arcing of said bridge at said primary contact area also maximizing said handle space (increasing the height of said handle space).

39. The lower hand grip as defined in claim 31 wherein:

said lower hand grip is attached externally to a thin, fabric type material which fits over the hand as a glove without finger extensions (fingerless glove), said lower hand grip attached externally to said fingerless glove to be called a base, once said base is positioned on the hand, an outer glove may be pulled over said base allowing a user to benefit from said lower hand grip while using any type or brand of said outer glove.

40. The lower hand grip as defined in claim 31 wherein:

said lower hand grip working in combination with an upper hand grip, said upper hand grip receiving a remainder of stress not absorbed by said lower hand grip, said upper hand grip serving primarily to prevent bruising to the thumb without impeding the proper movement of the thumb or adding stress to the wrist or thumb, said upper hand grip having structure which both anchors said upper hand grip and receives direct contact from the handle in the area extending from the lower web to the upper web, said structure extending from the upper and lower web along the thumb past the thumb second joint, partially encircling the thumb, thence thinning and extending downwardly and outwardly over (external of) the thumb base as a thumb harness, said thumb harness extending outwardly to a lifeline anchor, said lifeline anchor extending upwardly along the lifeline to said structure extending from the lower web to the upper web, said structure within the upper web angling toward the back of the hand as an upper web relocation press, said upper web relocation press serving to relocate the hand's fleshy upper and lower web areas downwardly under pressure of said outer glove.

* * * * *

UNITED STATES PATENT AND TRADEMARK OFFICE

CERTIFICATE OF CORRECTION

PATENT NO. : 7,963,864 B2
APPLICATION NO. : 12/316437
DATED : June 21, 2011
INVENTOR(S) : John H. Frost It is certified that error appears in the above-identified patent and that said Letters Patent is hereby corrected as shown below:

In column 22, line 4, Issued Claim 2 should be Claim 10, dependent on Claim 9.
In column 22, line 21, Issued Claim 3 should be Claim 11, dependent on Claim 10.
In column 22, line 29, Issued Claim 4 should be Claim 12, dependent on Claim 11.
In column 22, line 44, Issued Claim 5 should be Claim 13, dependent on Claim 12.
In column 23, line 4, Issued Claim 6 should be Claim 15, dependent on Claim 11.
In column 23, line 47, Issued Claim 7 should be Claim 2, dependent on Claim 1.
In column 23, line 61, Issued Claim 8 should be Claim 5, dependent on Claim 1.
In column 23, line 64, Issued Claim 9 should be Claim 6, dependent on Claim 1.
In column 24, line 10, Issued Claim 10 should be Claim 7, dependent on Claim 1.
In column 24, line 29, Issued Claim 11 should be Claim 16, dependent on Claim 7.
In column 24, line 45, Issued Claim 12 should be Claim 8, dependent on Claim 1.
In column 24, line 57, Issued Claim 13 should be Claim 9, dependent on Claim 1.
In column 25, line 4, Issued Claim 15 should be Claim 3, dependent on Claim 1.
In column 25, line 7, Issued Claim 16 should be Claim 4, dependent on Claim 1.

Signed and Sealed this
Fourth Day of October, 2011

David J. Kappos

David J. Kappos
*Director of the United States Patent and Trademark Office*